US005508154A

United States Patent [19]

Mizukawa et al.

[11] Patent Number: 5,508,154

[45] Date of Patent: Apr. 16, 1996

[54] SILVER HALIDE PHOTOGRAPHIC LIGHT-SENSITIVE MATERIAL, DEVELOPER, AND IMAGE-FORMING PROCESS

[75] Inventors: Yuki Mizukawa; Hidetoshi Kobayashi, both of Kanagawa, Japan

[73] Assignee: Fuji Photo Film Co., Ltd., Kanagawa, Japan

[21] Appl. No.: 356,581

[22] Filed: Dec. 15, 1994

[30] Foreign Application Priority Data

Dec. 15, 1993 [JP] Japan ..... 5-342321

[51] Int. Cl.[6] ..... G03C 5/305; G03C 1/34

[52] U.S. Cl. ..... 430/446; 430/489; 430/544; 430/614; 430/615

[58] Field of Search ..... 430/551, 544, 430/614, 615, 440, 446, 489, 490

[56] References Cited

U.S. PATENT DOCUMENTS

| | | | |
|---|---|---|---|
| 2,891,862 | 6/1959 | Van Allan | 430/615 |
| 3,554,757 | 1/1971 | Kuwabara et al. | 430/543 |
| 3,969,117 | 4/1976 | Sakai et al. | 430/446 |
| 4,307,186 | 12/1981 | De Brabandere et al. | 430/615 |
| 4,414,305 | 11/1983 | Nakamura et al. | 430/490 |
| 4,906,553 | 3/1990 | Ikegawa et al. | 430/440 |

FOREIGN PATENT DOCUMENTS 497348 3/1992 Japan .

*Primary Examiner*—Lee C. Wright

*Attorney, Agent, or Firm*—Sughrue, Mion, Zinn, Macpeak & Seas

[57] ABSTRACT

An image-forming process of a silver halide photographic material having at least one light-sensitive silver halide emulsion layer on a support, which comprises imagewise exposing the photographic material and developing the exposed photographic material using a developer under the presence of a compound represented by formula (I);

(I)

wherein Q represents a non-metallic atomic group having at least one of a nitrogen atom, an oxygen atom, and a sulfur atom. and which is necessary for forming a 5-membered heterocyclic ring together with the two carbon atoms of the 1,2,3-triazole ring; Y represents a substituent; and n represents 0 or an integer of from 1 to 3, when n is 2 or 3, Y's may be the same or different; and a silver halide photographic material and a developer each containing the compound represented by formula (I).

11 Claims, No Drawings

SILVER HALIDE PHOTOGRAPHIC LIGHT-SENSITIVE MATERIAL, DEVELOPER, AND IMAGE-FORMING PROCESS

FIELD OF THE INVENTION

The present invention relates to a silver halide photographic light-sensitive material, a developer for developing a photographic light-sensitive material, and an image-forming process of a photographic light-sensitive material.

BACKGROUND OF THE INVENTION

A phenomenon that the image density of the unexposed portions of a silver halide photographic light-sensitive material is increased by development processing is said to be the occurrence of a "development fog". Usually, the development fog is more liable to occur as the sensitivity of the photographic light-sensitive material is higher. Also, when a photographic light-sensitive material is stored for a long period of time or a photographic light-sensitive material is stored under the condition of a high temperature and a high humidity, a fog is also liable to occur. Furthermore, when a photographic light-sensitive material is subjected to high-temperature processing or high-active processing for shortening the processing time, the development fog is very liable to occur. Since such occurrence of a development fog causes photographic property deterioration such as lowering of an image contrast, etc., it is necessary to restrain the occurrence of the development fog as completely as possible.

For restraining the occurrence of the development fog, a method of adding an additive called an antifoggant to a photographic light-sensitive material or a developer has conventionally been employed. Such antifoggants are explained in detail, e.g., in Birr, *Stabilization of Photographic Silver Halide Emulsions*, published by Focal Press, 1974. Also, various compounds such as nitrogen-containing heterocyclic compounds are already proposed as antifoggants.

However, the compounds having a strong antifogging action have the problems that the compounds lower the sensitivity of photographic light-sensitive materials, soften the gradation of light-sensitive materials, or hinder the absorption of sensitizing dyes to silver halide grains to lower the spectral sensitivity, etc. Thus, the development of strong antifoggants giving less such problems has been desired.

Conventional antifoggants are mostly nitrogen-containing heterocyclic compounds, in particular, benzotriazole antifoggants are known and described in JP-B-60-29390 (corresponding to DE 2727194), JP-B-60-29391 (the term "JP-B" as used herein means an "examined published Japanese patent application") and U.S. Pat. No. 3,671,255. 1,2,3-triazole antifoggants having a condensed heterocyclic ring are disclosed, for example, in U.S. Pat. Nos. 3,554,757 and 4,307,186, and examples of such antifoggants, such as 1H-1,2,3-triazoro[4,5-b]pyridine antifoggants are also described in JP-A-3-138639 and JP-A-4-97348 (the term "JP-A" as used herein means an "unexamined published Japanese patent application").

SUMMARY OF THE INVENTION

An object of the present invention is to provide a silver halide photographic light-sensitive material wherein the occurrence of fog is prevented without causing the problems of lowering the sensitivity, etc.

Other object of the present invention is to provide a developer for developing a silver halide photographic material without causing fog.

Another object of the present invention is to provide an image-forming process without causing fog.

It has been discovered that the objects described above can be attained by the present invention as described hereinbelow.

According to an aspect of the present invention, there is provided a silver halide photographic light-sensitive material having at least one light-sensitive silver halide emulsion layer on a support, wherein the photographic light-sensitive material contains at least one compound represented by following formula (I);

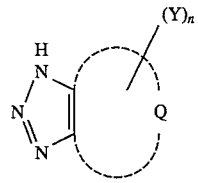

(I)

wherein Q represents a non-metallic atomic group having at least one of a nitrogen atom, an oxygen atom, and a sulfur atom and which is necessary for forming a 5-membered heterocyclic ring with the two carbon atoms of the 1,2,3-triazole ring; Y represents a substituent; and n represents 0 or an integer of from 1 to 3, when n is 2 or 3, Y's may be the same or different.

According to other aspect of the present invention, there is provided a developer for a silver halide photographic material, which contains at least one compound represented by the formula (I) described above.

According to another aspect of the present invention, there is provided a process of forming images by image-exposing a silver halide photographic material having at least one light-sensitive silver halide emulsion layer on a support and developing the photographic material using a developer to form images, which comprises carrying out the development in the presence of at least one compound represented by the formula (I) described above.

DETAILED DESCRIPTION OF THE INVENTION

The feature of the present invention is to use the compound shown by the formula (I) described below as an antifogging agent. The antifoggant can be added to a photographic light-sensitive material. Also, the antifoggant may be added to a developer and further, after the initiation of the use of a photographic light-sensitive material (that is, after initiation of the image-exposure of the photographic light-sensitive material) and before finishing development processing, the antifoggant is incorporated in the photographic light-sensitive material or the developer and the development may be practiced in the presence of the antifoggant. For example, after image-exposure, the photographic light-sensitive material is immersed in a liquid (a prebath for development) containing the antifoggant and thereafter, development processing may be practiced. The image-forming process of the present invention includes the embodiment of practicing development processing in the presence of the antifoggant as described above.

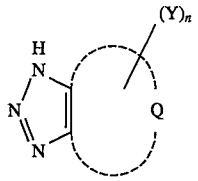

(I)

wherein Q represents a non-metallic atomic group having at least one of a nitrogen atom, an oxygen atom, and a sulfur atom and which is necessary for forming a 5-membered heterocyclic ring together with two carbon atoms of a 1,2,3-triazole ring; Y represents a substituent; and n represents 0 or an integer of from 1 to 3, when n is 2 or 3 Y's may be the same or different.

Then, the compound shown by the formula (I) is explained in detail.

In the formula (I), Y represents a substituent. Examples of the substituent include a halogen atom (e.g., fluorine, chlorine, bromine, and iodine), a hydroxy group, a cyano group, a nitro group, —COOM, —$SO_3M$, and —SM (wherein M represents H or an alkali metal atom such as Li, Na and K), an alkyl group (preferably, a straight chain or branched alkyl group having from 1 to 12 carbon atoms, e.g., methyl, ethyl, propyl, butyl, isopropyl, t-butyl, 1-octyl, and 2-ethylhexyl), a cycloalkyl group (preferably, a cycloalkyl group having from 3 to 8 carbon atoms, e.g., cyclopropyl, cyclopentyl, and cyclohexyl), an alkenyl group (preferably an alkenyl group having from 2 to 12 carbon atoms, e.g., vinyl, allyl, and 3-buten-2-yl), an aryl group (preferably, an aryl group having from 6 to 16 carbon atoms, e.g., pnenyl, 1-naphthyl, and 2-naphthyl), a heterocyclic group (preferably, a 5- to 8-membered heterocyclic group having from 1 to 16 carbon atoms and at least one of N, O and S atoms as a hetero atom, and the heterocyclic group may be condensed with a benzene ring (in the present invention a heterocyclic group has the same defenition as defined herein unless otherwise defined), e.g., 2-thienyl, 4-pyridyl, 2-furyl, 2-pyrimidyl, 1-pyridyl, 2-benzothiazolyl, 1-imidazolyl, 1-pyrazolyl, and benzotriazol-2-yl), an alkoxy group (preferably, an alkoxy group having from 1 to 16 carbon atoms, e.g., methoxy, ethoxy, propoxy, 1-butoxy, 2-butoxy, isopropoxy, t-butoxy, and dodecyloxy), a cycloalkyloxy group (preferably, a cycloalkyloxy group having from 3 to 8 carbon atoms, e.g., cyclopentyloxy and cyclohexyloxy), an aryloxy group (preferably, an aryloxy group having from 6 to 16 carbon atoms, e.g., phenoxy and 2-naphthoxy), a heterocyclic ring oxy group (preferably, a heterocyclic oxy group having from 1 to 16 carbon atoms, e.g., 1-phenyltetrazol-5-oxy, 2-tetrahydropyranyloxy, and 2-furyloxy), silyloxy group (preferably, a silyloxy group having from 1 to 16 carbon atoms, e.g., trimethylsilyloxy, t-butyldimethylsilyloxy, and diphenylmethylsilyloxy), an acyloxy group (in the present invention an acyl moiety includes a formyl moiety an aliphatic- and aromatic-acyl moiety unless otherwise defined) (preferably, an acyloxy group having from 1 to 16 carbon atoms, e.g., acetoxy, pivaloyloxy, benzoyloxy, and octanoyloxy), an alkoxycarbonyloxy group (preferably, an alkoxycarbonyloxy group having from 2 to 16 carbon atoms, e.g., methoxycarbonyloxy, ethoxycarbonyloxy, propyloxycarbonyloxy, t-butoxycarbonyloxy), a cycloalkyloxycarbonyloxy group (preferably, a cycloalkyloxycarbonyloxy group having from 4 to 12 carbon atoms, e.g., cyclohexyloxycarbonyloxy), an aryloxycarbonyloxy group (preferably, an aryloxycarbonyloxy group having from 7 to 16 carbon atoms, e.g., phenoxycarbonyloxy), a carbamoyloxy group (preferably, a carbamoyloxy group having from 0 to 16 carbon atoms, e.g., N,N-dimethylcarbamoyloxy and N-butylcarbamoyloxy), a sulfamoyloxy group (preferably, a sulfamoyloxy group having from 0 to 16 carbon atoms, e.g., N,N-dimethylsulfamoyloxy, N-ethylsulfamoyloxy, and N-phenylsulfamoyloxy), an alkanesulfonyloxy group (preferably, an alkanesulfonyloxy group having from 1 to 16 carbon atoms, e.g., methanesulfonyloxy, butanesulfonyloxy, and hexadecanesulfonyloxy), an arenesulfonyloxy group (preferably, an arenesulfonyloxy group having from 6 to 16 carbon atoms, e.g., benzeneslfonyloxy), an acyl group (preferably, an acyl group having from 1 to 16 carbon atoms, e.g., hormyl, acetyl, pivaloyl, benzoyl, and octanoyl), an alkoxycarbonyl group (preferably, an alkoxycarbonyl group having from 2 to 16 carbon atoms, e.g., methoxycarbonyl, ethoxycarbonyl, and tetradecyloxycarbonyl), a cycloalkyloxycarbonyl (preferably, a cycloalkyloxycarbonyl group having from 4 to 10 carbon atoms, e.g., cyclohexylcarbonyl), an aryloxycarbonyl group (preferably, an aryloxycarbonyl group having from 7 to 18 carbon atoms, e.g., phenoxycarbonyl), a carbamoyl group (preferably, a carbamoyl group having from 1 to 16 carbon atoms, e.g., carbamoyl, N,N-dimethylcarbamoyl, N,N-diethylcarbamoyl, N-methyl-N-octylcarbamoyl, and N-propylcarbamoyl), an amino group (preferably, an amino group having not more than 18 carbon atoms, e.g., amino, methylamino, ethylamino, butylamino, N,N-dibutylamino, and tetradecylamino), an anilino group (preferably, an anilino group having from 6 to 18 carbon atoms, e.g., anilino and N-methylanilino), a heterocylic ring amino group (preferably, a heterocyclic amino group having from 1 to 18 carbon atoms, e.g., 4-pyridylamino), a carbonamido group such as an alkyl- and aryl- carbonamido group (preferably, a carbonamido group having from 2 to 18 carbon atoms, e.g., acetamido, propanamido, butanamido, benzamido, and tetradecanamido), a ureido group (preferably, a ureido group having from 1 to 18 carbon atoms, e.g., ureido, N,N-dimethylureido, and N-phenylureido), an imido group (preferably, an imido group having not more than 10 carbon atoms, e.g., N-succinimido and N-phthalimido), an alkoxycarbonylamino group (preferably, an alkoxycarbonylamino group having from 2 to 18 carbon atoms, e.g., methoxycarbonylamino, ethoxycarbonylamino, t-butoxycarbonylamino, and 2-ethylhexyloxycarbonylamino), an aryloxycarbonylamino group (preferably, an aryloxycarbonylamino group having from 7 to 18 carbon atoms, e.g., phenoxycarbonylamino), a sulfonamido group such as an alkane- and arene- sulfonamido group (preferably, a sulfonamido group having from 1 to 18 carbon atoms, e.g., methanesulfonamido, ethanesulfonamido, butanesulfonamido, octanesulfonamido, and benzenesulfonamido), a sulfamoylamino group (preferably, a sulfamoylamino group having from 0 to 18 carbon atoms, e.g., N,N-dimethylsulfamoylamino, N,N-diethylsulfamoylamino, and N-methyl-N-octylsulfamoylamino), an azo group such as an alkyl- and aryl- azo group (preferably, an azo group having from 1 to 18 carbon atoms, e.g., phenylazo), an alkylthio group (preferably, an alkylthio group having from 1 to 18 carbon atoms, e.g., methylthio, ethylthio, propylthio, butylthio, and octylthio), an arylthio group (preferably, an arylthio group having from 6 to 18 carbon atoms, e.g., phenylthio and naphthylthio), a heterocyclic ring thio group (preferably, a heterocylic ring thio group having from 1 to 18 carbon atoms, e.g, 2-benzothiazolylthio, 2-pyridylthio, and 1-phenyltetrazolylthio), an alkanesulfinyl group (preferably, an alkanesulfinyl group having from 1 to 18 carbon atoms, e.g., ethanesulfinyl, butanesulfinyl, and octanesulfinyl), an arenesulfinyl group (preferably, an arenesulfinyl group having from 6 to 18 carbon atoms, e.g., benzenesulfinyl), an alkane sulfonyl group (preferably, an alkanesulfonyl group having from 1 to 18 carbon atoms, e.g., methanesulfonyl, octanesulfonyl), an arenesulfonyl group (preferably, an arenesulfonyl group having from 6 to 18 carbon atoms, e.g., benzenesulfonyl, 1-naphthalene sulfonyl) a sulfamoyl group (preferably, a sulfamoyl group having not more than 20 carbon atoms, e.g., sulfamoyl, N,N-diethylsulfamoyl, N,N-dipropylsulfamoyl, and N-ethyl-N-octysulfmaoyl), and a phosphinoyl group ($(R)_2$—P(O)—; R represents a hydrogen atom and a group such as an alkyl group, an aryl group, an alkoxy group, or an aryloxy group) (preferably, a phosphinoyl group having from 1 to 20 carbon atoms, e.g., phenoxyphosphinoyl, octyloxyphosphinoyl, butyloxyphosphinoyl, and phenyloxyphosphinoyl).

The foregoing substituents shown by Y each may have further a substituent (the above-disclosed carbon numbers include the carbon numbers of the substituent) and as examples of the preferred substituent, there are a halogen atom (e.g., F, Cl, Br, I), an alkyl group, a cycloalkyl group, an alkenyl group, an aryl group, a heterocyclic group, a acyano group, a nitro group, an alkoxy group, an aryloxy group, a heterocyclic ring oxy group, an acyloxy group, an alkoxycarbonyloxy group, a cycloalkyloxycarbonyl group, an aryloxycarbonyloxy group, an alkylthio group, an arylthio group, a heterocyclic ring thio group, a carbamoyloxy group, a sulfamoyloxy group, an alkanesulfonyloxy group, an arenesulfonyloxy group, an alkoxycarbonyl group, a cycloalkyloxycarbonyl group, an aryloxycarbonyl group, a carbamoyl group, an amino group, an anilino group, a heterocyclic ring amino group, a carbonamido group, a ureido group, an imido group, an alkoxycarbonylamino group, an aryloxycarbonyl amino group, a sulfonamido group, a sulfamoylamino group, an alkanesulfonyl group, an arenesulfonyl group, a sulfamoyl group, —COOM, —$SO_3M$ and —SM (M represents H or an alkali metal atom such as Li, Na and K) a hydroxy group, an azo group, a sulfinyl group, and a phosphinoyl group. As examples of each of these groups may be provided the same as in the examples of the substituent represented by Y.

Y is preferably an alkyl group, an aryl group, an alkoxy group, an aryloxy group, an acyloxy group, an alkylthio group, an arylthio group, a heterocylic ring thio group, a carbmoyloxy group, a sulfamoyloxy group, an alkanesulfonyloxy group, an arenesulfonyloxy group, an alkoxycarbonyl group, an aryloxycarbonyl group, a carbamoyl group, an amino group, an anilino group, a heterocyclic ring amino group, a carbonamido group, a ureido group, an imido group, an alkoxycarbonylamino group, an aryloxycarbonylamino group, an alkanesulfonyl group, an arenesulfonyl group, a sulfamoyl group, a —COOM, —$SO_3M$ and SM (wherein M has the same definition as above), a hydroxy group, and a phosphinoyl group, and is more preferably an alkyl group, an aryl group, an alkoxy group, an aryloxy group, an acyloxy group, an alkylthio group, an arylthio group, a heterocyclic ring thio group, a carbamoyloxy group, a sulfamoyloxy group, an alkoxycarbonyl group, an aryloxycarbonyl group, a carbamoyl group, an amino group, an anilino group, a heterocyclic ring amino group, a carbonamido group, a ureido group, an alkoxycarbonylamino group, an aryloxycarbonylamino group, an alkanesulfonyl group, an arenesulfonyl group, a sulfamoyl group, —COOM and —SM (wherein M has the same meaning as hereinabove), and a hydroxy group.

In the formula (I), n represents 0 or an integer of from 1 to 3 and when n is 2 or 3, plural Y's may be the same or different. Furthermore, n is preferably from 1 to 3, and more preferably 1 or 2.

In the formula (I), Q represents a non-metallic atomic group having at least one of a nitrogen atom, an oxygen atom, and a sulfur atom and necessary for forming a 5-membered ring together with the two carbon atoms of the 1,2,3-triazole ring.

Then, specific formulae (formula (II) to formula (XV)) of the compounds shown by the formula (I) are shown below but the invention is not limited by these compounds of the formulae.

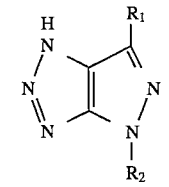
(II)

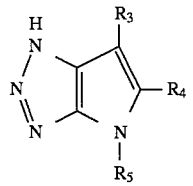
(III)

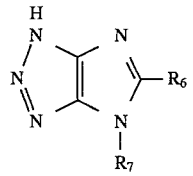
(IV)

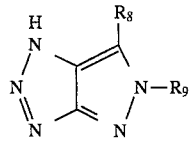
(V)

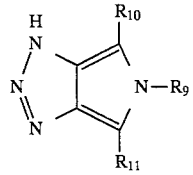
(VI)

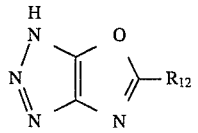
(VII)

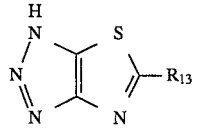
(VIII)

-continued (IX)

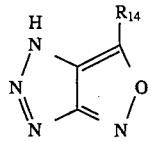

(X)

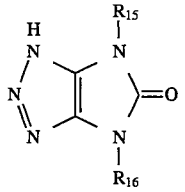

(XI)

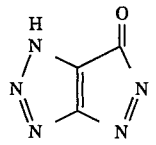

(XII)

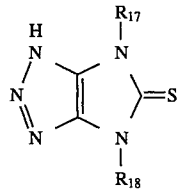

(XIII)

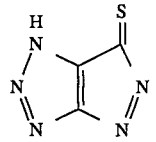

(XIV)

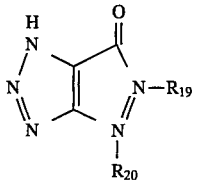

(XV)

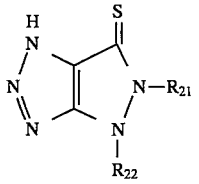

In the above formulae, $R_1$, $R_2$, $R_3$, $R_4$, $R_5$, $R_6$, $R_7$, $R_8$, $R_9$, $R_{10}$, $R_{12}$, $R_{13}$, $R_{14}$, $R_{15}$, $R_{16}$, $R_{17}$, $R_{18}$, $R_{19}$, $R_{20}$, $R_{21}$, and $R_{22}$ each represents a hydrogen atom or a substituent.

The substituents shown by $R_1$ to $R_{22}$ have the same meanings as explained for Y of the formula (I) described above.

In the compounds shown by the formula (I), the compounds shown by the formula (II), the formula (III), the formula (IV), the formula (V), the formula (VI), the formula (VII), and the formula (VIII) are preferred, the compounds shown by the formula (II), the formula (III), the formula (IV), and the formula (V) are more preferred, and the compounds shown by the formula (II), the formula (IV), and the formula (V) are the most preferred. These compounds may be in a form of a salt of an alkali metal at a nitrogen atom of the 1,2,3-triazole ring.

Then, specific examples of the compound shown by the formula (I) are illustrated below but the invention is not limited to these compounds.

An alkyl group in a formula of a compound in the present invention which does not have any indication such as i- or t- represents an n- alkyl group.

A-1

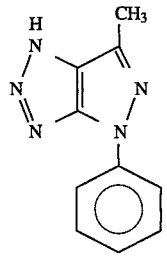

A-2

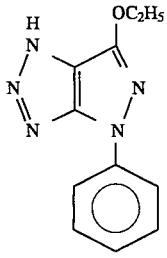

A-3

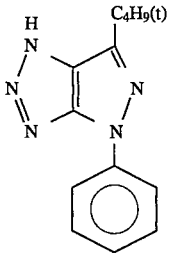

A-4

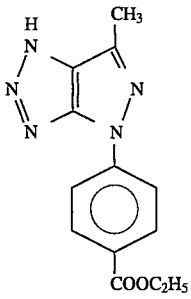

A-5

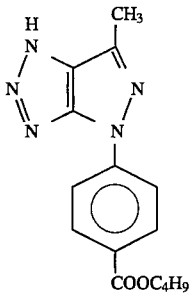

-continued
A-6
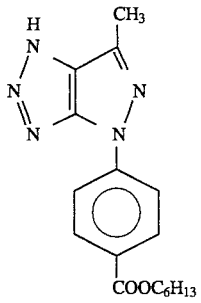
A-7
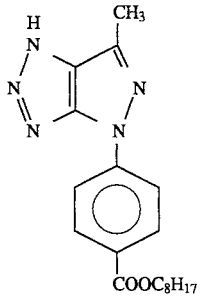
A-8
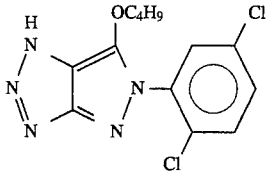
A-9
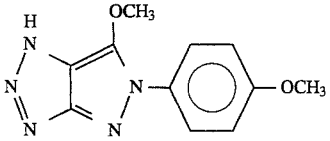
A-10
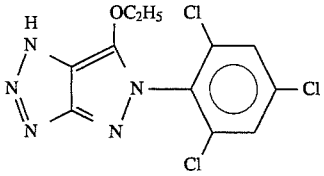
A-11
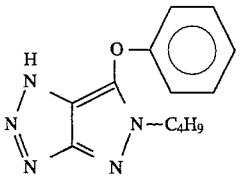
A-12
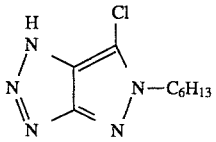
A-13
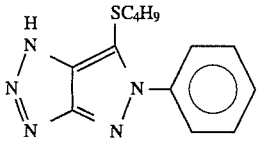
-continued
A-14
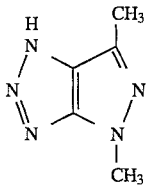
A-15
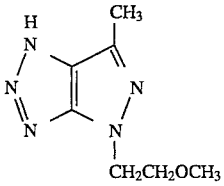
A-16
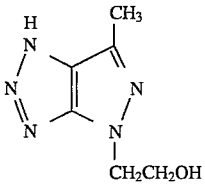
A-17
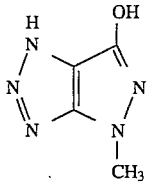
A-18
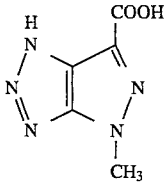
A-19
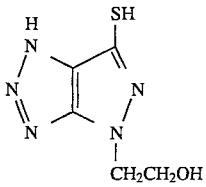
A-20
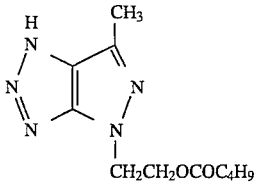
A-21
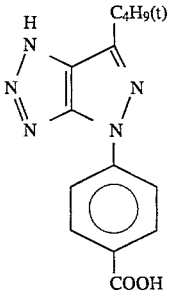

-continued
A-22
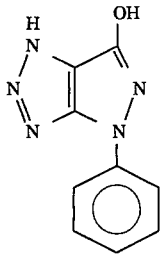
A-23
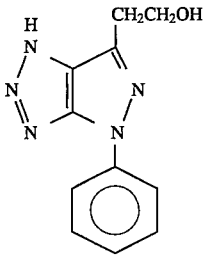
A-24
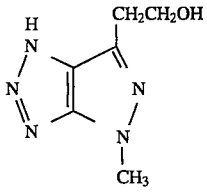
A-25
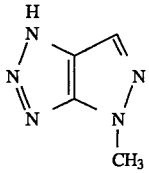
A-26
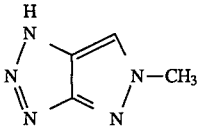
A-27
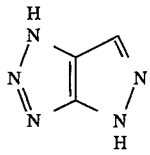
A-28
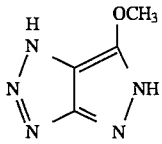
A-29
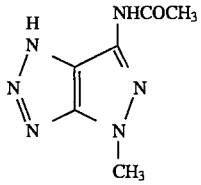
-continued
A-30
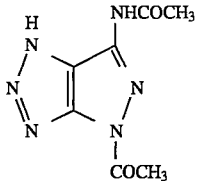
A-31
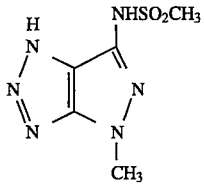
A-32
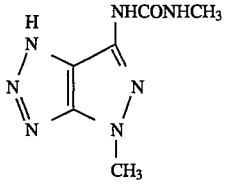
A-33
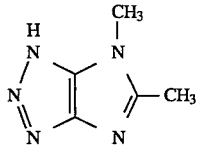
A-34
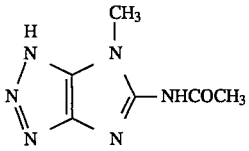
A-35
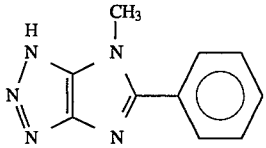
A-36
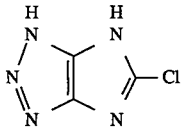
A-37
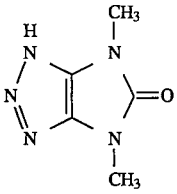
A-38
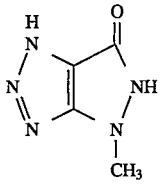

-continued

A-39

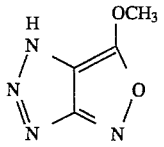

A-40

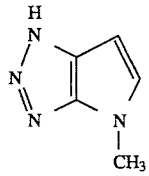

A-41

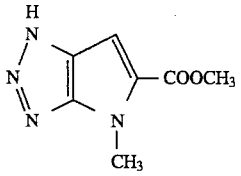

A-42

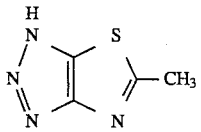

A-43

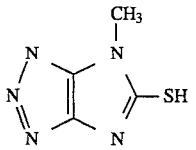

A-44

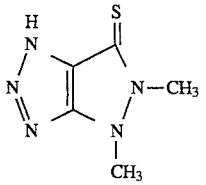

A-45

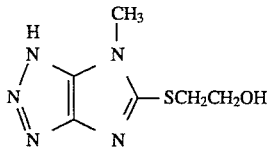

A-46

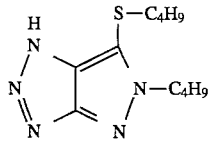

A-47

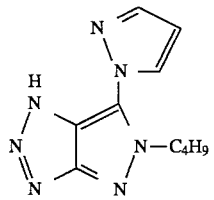

Then, the specific synthesis examples of the compound shown by the formula (I) are illustrated below.

Synthesis Example—1 (Compound A -1)

Synthesis Scheme [A]

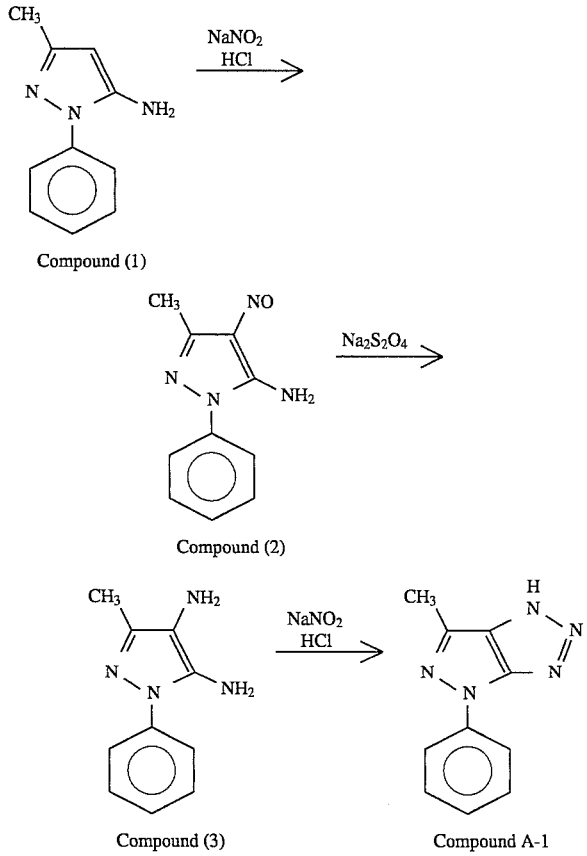

Synthesis of Compound (2)

To 86.6 g of an aminopyrazole compound (Compound (1)) were added 129 ml of concentrated hydrochloric acid and 250 ml of water and the mixture was stirred at 0° C. To the solution formed was added dropwise a solution of 38 g of sodium nitrite dissolved in 80 ml of water and thereafter, the mixture was stirred for 2 hours at a temperature of from 5° C. to 10° C. After the reaction was over, 1000 ml of water was added to the reaction mixture and the mixture was neutralized by further adding thereto sodium hydrogencarbonate. Crystals thus precipitated were collected by filtration and after washing with water and then with 500 ml of acetonitrile, were dried to provide 71.0 g (70.2%) of a nitroso compound (Compound (2)).

Proton NMR, (ppm) (multiplicity, integrated value)

(DMSO d6) 8.48 to 8.23(br, 2H), 7.75 to 7.35 (m, 5H), 2,67(s,3H)

Synthesis of Compound (3)

To 40.4 g of the nitroso compound (Compound (2)) obtained in the above-described method were added 500 ml of water and 100 ml of methanol and the mixture was stirred under heating. To the solution thus formed was added little by little 80 g of sodium hydrosulfite and thereafter, the mixture was stirred under heating for one hour. After the reaction was over, the reaction mixture was cooled to room temperature and extracted with ethyl acetate. The ethyl acetate solution was washed with water and after drying with anhydrous magnesium sulfate, ethyl acetate was distilled off. The residue formed was recrystallized from the mixed solvent of chloroform and hexane to provide 21.7 g (57.7%) of a diamino compound (Compound (3)).

Synthesis of Compound A-1

To 18.8 g of the diaminO compound (Compound (3)) obtained in the above described method were added 25.7 g of concentrated hydrochrolic acid and 150 ml of water and the mixture was cooled to a temperature of from 5° to 10° C. and stirred. To the solution formed were added dropwise 7.6 g of sodium nitrite dissolved in 20 ml of water, and thereafter the mixture was stirred for 1 hour. After the reaction was over, the reaction solution was neutralized by adding thereto sodium hydrogencarbonate little by little. The reaction mixture was extracted by ethylacetate. After the ethylacetate solution was washed with water, ethylacetate was distilled off under reduced pressure. The residue formed was recrystallized from acetonitrile to obtaine 14.3 g (71.9%) of Compound (A-1).

Proton NMR, (ppm) (multipliticy, integrated value)

(DMSO d6) 12.5 to 12.15(br, 1H), 8.07 to 7.80(m, 2H), 7.65 to 7.43(m, 2H), 7.31 to 7.12(m, 1H), 2.55(s, 3H)

Synthesis Example—2 (Compound A -3)

Synthesis Scheme (B)

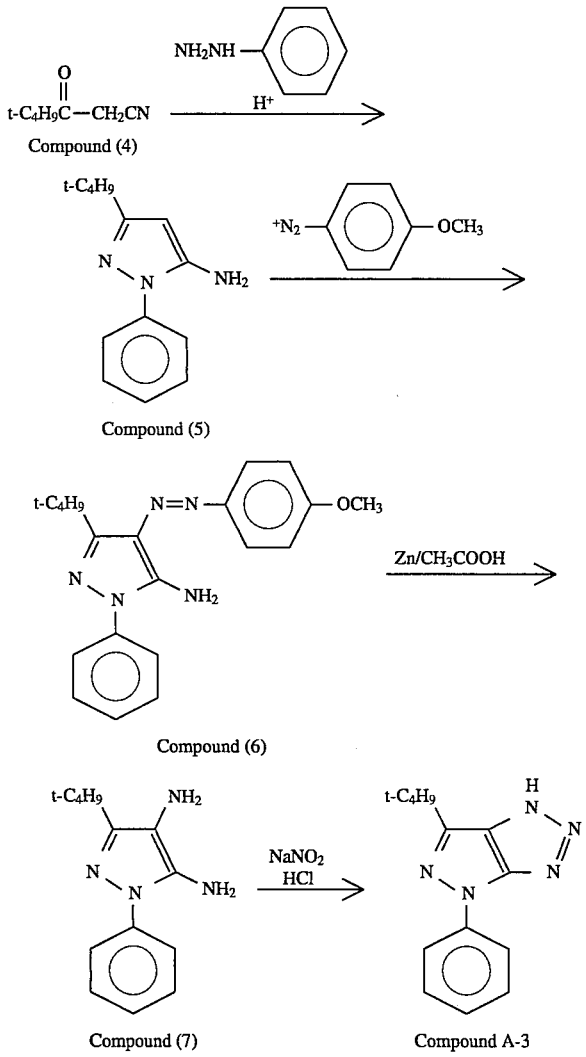

Synthesis of Compound (5)

To 25.0 g of pivaloylacetonitrile (Compound (4)) was added 50 ml of ispropanol and the mixture was stirred under heating. To the solution obtained was added dropwise 21.6 g of phenylhydrazine. Thereafter, the mixture was stirred under heating for 2 hours. To the reaction mixture obtained 5 ml of methanesulfonic acid was added, and thereafter the mixture was stirred for 2 hours. After the reaction was over, the reaction mixture was cooled to room temperature and after adding thereto 500 ml of water, the reaction mixture was neutralized with sodium hydrogencarbonate. Crystal thus precipitated were collected by filtration, washed with water, and dried to provide 42.6 (98.9%) of an aminopyrazole compound (Compound (5)).

Synthesis of Compound (6)

To 23.4 g of paramethoxyaniline were added 49.0 ml of concentrated hydrochloric acid and 100 ml of water and the mixture was cooled to at a temperature of from 0° C. to 10° C. and stirred. To the solution thus formed was added dropwise a solution of 14.4 g of sodium nitrite dissolved in 30 ml of water and thereafter, the mixture was stirred for 30 minutes to synthesize a diazonium salt.

Then, a solution obtained by adding 100 ml of water and 200 ml of methanol to 34.0 g of the aminopyrazole compound (Compound (5)) obtained by the method descrived above and 46.8 g of sodium acetate was cooled to a temperature of from 5° C. to 10° C. and stirred. To the solution was added dropwise the solution of the foregoing diazonium salt and thereafter, the resultant mixture was stirred for one hour. After the reaction was over, 1000 ml of water was added to the reaction mixture followed by stirring. Crystals thus precipitated were collected by filtraton and dried to provide 52.0 g (94.2%) of an azo dye (Compound (6)).

Synthesis of Compound (7)

To 38.0 g of the azo dye (Compound (6)) obtained by the method described above and 35.6 g of a zinc powder was added 250 ml of methanol and the mixture obtained was stirred under heating. To the solution thus obtained was added dropwise 37.2 ml of acetic acid and thereafter, the resultant mixture was stirred under heating for one hour. After the reaction was over, the reaction mixture was filtered at the hot state to remove insoluble matters and 1000 ml of water was added to the filtrate to precipitate crystals, which were collected by filtration, washed with water, and dried, whereby 40.8 g of a complex of a diamino compound (Compound (7)) and zinc was obtained.

Synthesis of Compound A -3

To 22.6 g of the diamino compound (Compound (7)) obtained by the method described above were added 12.9 ml of concentrated hydrochloric acid and 120 ml of water and the mixture was cooled to a temperature of from 5° C. to 10° C. and stirred. To the solution thus obtained was added dropwise a solution of 2.07 g of sodium nitrite dissolved in 5 ml of water and thereafter, the mixture was stirred for 2 hours. After the reaction was over, 500 ml of water added to the reaction mixture and then the mixture was neutralized with sodium hydrogencarbonate. Crystals thus precipitated were collected by filtration and purified by a column chromatography to provide 10.4 g of Compound A -3. The melting point thereof was from 120° C. to 121° C.

Proton NMR (ppm) (multipliticy, integrated value)

($CDCl_3$) 12.72 to 12.35(Br, 1H), 8.05(d, 2H), 7.60 tp 7.39(m, 2H), 7.32 to 7.12(m, 1H), 1.55(s, 9H)

Synthesis Example 3 (Compound A -8)

Synthesis Scheme (C)

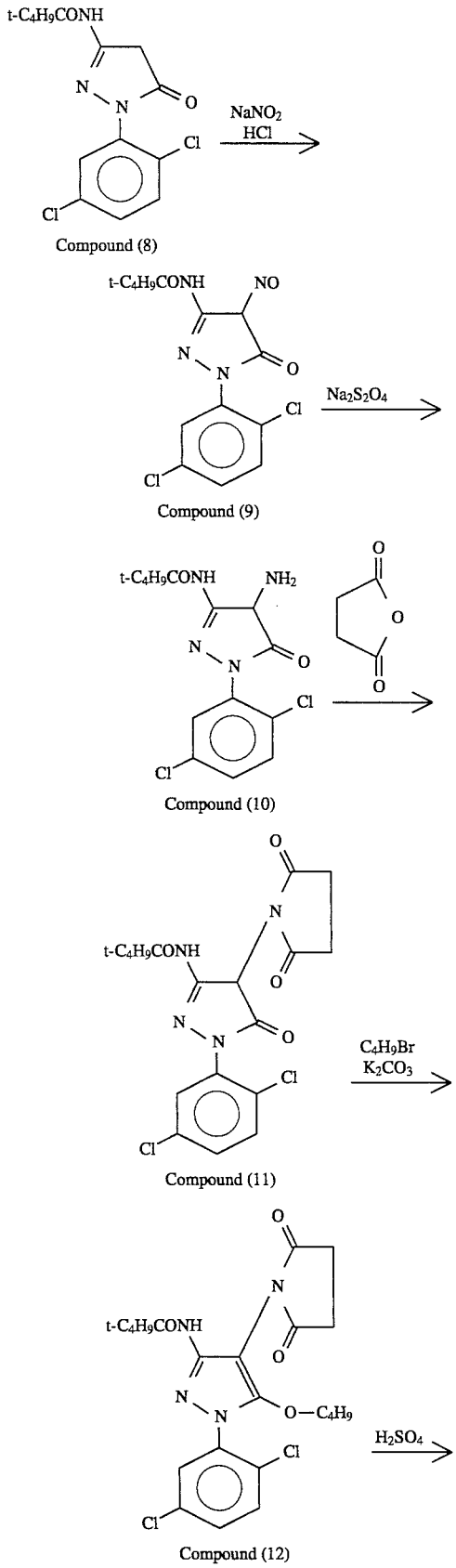

-continued

Synthesis Scheme (C)

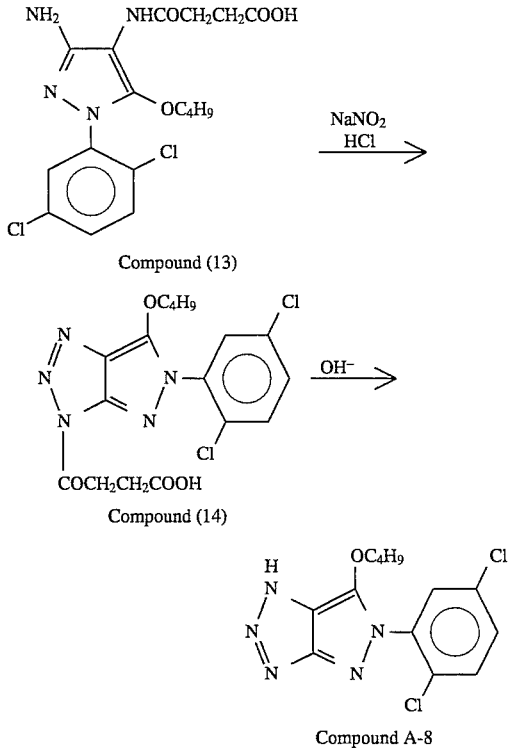

Synthesis of Compound (9)

To 32.8 g of a pyrazolone compound (Compound (8)) were added 200 ml of methanol and 20 ml of water and the mixture thus obtained was cooled to 0° C. and stirred. To the solution formed was added 10.5 ml of concentrated hydrochloric acid and then a solution of 7.6 g of sodium nitrite dissolved in 20 ml of water was added dropwise to the mixture. Thereafter, the resultant mixture was stirred for one hour at a temperature of from 5° C. to 10° C. After the reaction was over, 500 ml of water was added to the reaction mixture to precipitate crystals, which were collected by filtration, washed with water, and dried to provide 35.7 g (100%) of a nitroso compound (Compound (9)).

Synthesis of Compound (10)

To 35.7 g of the nitroso compound (Compound (9)) obtained by the method described above were added 160 ml of methanol and 200 ml of water and the mixture was stirred under heating. To the solution formed was added 63 g of sodium hydrosulfite as few separated parts. Thereafter, the mixture was stirred under heating for one hour. After the reaction was over, the reaction mixture was cooled to room temperature and then 500 ml of water was added thereto to precipitate crystals, which were collected by filtration, washed with water, and dried to provide 32.1 g (93.5%) of an amine compound (Compound (10 )).

Synthesis of Compound (11)

To 18.8 g of the amine compound (Compound (10)) obtained in the method described above was added 75 ml of acetonitrile and the mixture was stirred under heating. To the solution thus formed was added 5.6 g of succinic anhydride and the mixture was stirred under heating for 4 hours. Then, to the solution was added 1 ml of methanesulfonic acid and the resultant mixture was further stirred under heating for 4 hours. After the reaction was over, the reaction mixture was cooled to room temperature and then 50 ml of water and 50 ml of ethyl acetate were added thereto to precipitate crystals, which were collected by filtration, washed with ethyl acetate and then water, and dried to provide 21.0 g (89.8%) of an imide compound (Compound (11)).

Proton NMR (ppm) (multipliticy, integrated value)

(DMSO d6) 10.70 to 10.21(br, 1H), 9.61(s, 1H), 7.70(dd, 1H), 7.65 to 7.55(m, 2H), 2.80 to 2.55(br, 4H), 1.12(s, 9H)

Synthesis of Compound (12)

43.6 g of the imide compound (Compound (11)) obtained in the method described above were added 22.8 g of potassium carbonate and 160 ml of dimethylacetoamide and the mixture was stirred under heating. To the solution formed was added dropwise 13.5 g of butyl bromide and the resultant mixture was stirred under heating for 2 hours. After the reaction was over, the reaction mixture was poured into water and extracted with ethyl acetate. The ethyl acetate solution (the extract) was washed with water, dried with anhydrous magnesium sulfate, and then ethyl acetate was distilled off under reduced pressure. The residue formed was purified by a silica gel column chromatography to provide 30.2 g (77.0%) of an oily compound (12).

Proton NMR (ppm) (multipliticy, integrated value)

($CDCl_3$) 7.68(s, 1H), 7.52 to 7.30(m, 3H), 4.04(t, 2H), 3.02 to 2.67(br, 4H), 1.50(tt, 2H), 1.33 to 1.08(m, 2H), 1.22(s, 9H), 0.78(t, 3H)

Synthesis of Compound (13)

To 9.63 g of the imide compound (Compound (12)) obtained in the method described above was added 50 ml of ethanol and the mixture was stirred under heating. To the solution thus formed was added dropwise 3.37 ml of concentrated sulfuric acid and the resultant mixture was stirred under heating for 3 hours. After the reaction was over, the reaction mixture was poured into 500 ml of water, neutralized with sodium hydrogencarbonate, and then extracted with ethyl acetate. The ethyl acetate solution (the extract) was washed with water, dried with anhydrous magnesium sulfate, and then ethyl acetate was distilled off under reduced pressure. The resodie thus formed was purified by a silica gel column chromatography to provide 5.2 g (58.6%) of an oily compound (13).

Proton NMR (ppm) (multipliticy, integrated value)

($CDCl_3$) 7.55 to 7.24(m, 4H), 4.28 to 4.05(m, 4H), 3.90(br, 2H), 2.83 to 2.47(br, 4H), 1.65 to 1.41(m, 2H), 1.37 to 1.02(m, 5H), 0.82(t, 3H)

Synthesis of Compound A -8

To 12.3 g of the amino compound (Compound (13)) obtained in the method described above were added 10 ml of water and 120 ml of methanol and the mixture was cooled to 5° C. and stirred. To the solution thus formed was added 7.2 ml of concentrated hydrochloric acid and further added dropwise a solution of 2.07 g of sodium nitrite dissolved in 5 ml of water. Thereafter, the resultant mixture was stirred under heating at a temperature of from 5° C. to 10° C. for 2 hours. After the reaction was over, the reaction mixture was neutralized by adding dropwise an aqueous solution of sodium hydrogencarbonate. The solution was extracted with ethyl acetate.

The ethyl acetate solution was washed with water and then ethyl acetate was distilled under reduced pressure. To the residue (Compound (14)) formed were added 50 ml of methanol and 10 ml of concentrated aqueous ammonia and the resultant mixture was heated to 40° C. followed by stirring. After the reaction was over, the reaction mixture was neutralized with the addition of acetic acid. The reaction mixture was then extracted with the addition of ethyl acetate. The ethyl acetate solution was washed with water, dried with anhydrous magnesium sulfate, and then ethyl acetate was distilled off under reduced pressure. To the residue thus formed was added acetonitrile to precipitate crystalls, which were collected by filtration, dried, and purified by carrying out a recrystallization from acetonitrile to provide 4.9 g (54.5%) of Compound A -8.

Proton NMR (ppm) (multipliticy, integrated value)

(DMSO d6) 7.93 to 7.61(m, 3H), 4.71(t, 2H), 1.88 to 1.67(m, 2H), 1.50 to 1.26 (m, 2H), 0.90(t, 3H)

The NMR spectral data of the other compounds synthesized according to the methods described above are shown in Table 1 below.

TABLE 1

| Compound No. | Proton NMR δ(ppm) (Multiplicity, Integrated Value) |
|---|---|
| A-2 | (DMSO-d6) 12.6 to 11.97(br, 1H), 7.87(d, 2H) 7.45(dd, 2H), 7.12(dd, 1H), 4.57(q, 2H), 1.53(t, 3H) |
| A-5 | ($CDCl_3$) 12.30(s, 1H), 8.21(d, 2H), 8.04(d, 2H), 4.35(t, 2H), 2.62(s, 3H), 1.88 to 1.40(m, 4H), 1.0(t, 3H) |
| A-6 | ($CDCl_3$) 12.52(s, 1H), 8.21(d, 2H), 8.05(d, 2H), 4.36(t, 2H), 2.68(s, 3H), 1.90 to 1.61(m, 2H), 1.55 to 1.19(m, 6H), 0.91(t, 3H) |
| A-7 | ($CDCl_3$) 12.62(s, 1H), 8.20(d, 2H), 8.06(d, 2H), 4.36(t, 2H), 2.65(s, 3H), 1.90 to 1.67(m, 2H), 1.55 to 1.11(m, 10H), 0.87(t, 3H) |
| A-21 | (DMSO-d6) 12.95(s, 1H), 12.30 to 12.0(br. 1H) 8.14(d, 2H), 8.03(d, 2H), 1.49(s, 9H) |

In the case of adding the compound represented by formula (I) of the present invention to the silver halide photographic material of this invention, the addition amount thereof is preferably from $10^{-8}$ to $10^{-2}$ mole, more preferably from $10^{-7}$ to $10^{-3}$ mole, and particularly preferably from $10^{-6}$ to $10^{-3}$ mole per mole of silver. When the amount exceeds $10^{-2}$, sensitivity tends to decrease. As the method of adding the compound to the photographic light-sensitive material, it is general to dissolve the compound in water, an aqueous alkali solution, or a water-soluble organic solvent such as methanol, ethanol, acetone, cyclohexanone, tetrahydrofuran, dioxane, N,N-dimethylformamide, N,N-dimethylacetamide, etc., and adding the solution to a silver halide emulsion or to a coating liquid at the preparation thereof. As other addition method of the compound, there are a method of adding a latex impregnated with the compound, a method of dissolving the compound together with a coupler, a high-boiling organic solvent (e.g., dibutyl phthalate, trioctyl phosphate, and tricresyl phosphate), and an auxiliary solvent (e.g., ethyl acetate and methoxyethoxyethyl acetate), emulsifying the solution together with gelatin and a surface active agent, and adding as the emulsion, etc.

In the case of adding the compound represented by formula (I) of the present invention to a developer, the addition amount thereof is in the range preferably of from $10^{-8}$ to $10^{-2}$ mole/liter, more preferably from $10^{-7}$ to $10^{-3}$ mole/liter, and particularly preferably from $10^{-6}$ to $10^{-3}$ mole/liter. In this case, it is preferred that the compound of this invention is added to a black and white developer, a color developer or the pre-bath thereof. As the addition method of the compound of this invention to the processing liquid, the compound is added as the powder thereof to the processing liquid and dissolved therein or the compound is previously dissolved in water, an aqueous alkali solution, or a water-miscibe organic solvent (methanol, N,N-dimethylformamide, etc.) and then the solution is added to the processing liquid.

In the case of adding the compound represented by formula (I) of the invention to the photographic light-sensitive material of this invention, the compound may be added to the light-sensitive silver halide emulsion layer or the light-insensitive layer (e.g., a protective layer, a yellow filter layer, an antihalation layer, and interlayers) but is preferably added to the silver halide emulsion layer.

The photographic light-sensitive material of the present invention may have at least one light-sensitive silver halide emulsion layer formed on a support. The photographic light-sensitive material may be a black and white photographic light-sensitive material or a color photographic light-sensitive material. A typical example is a silver halide photographic material having on a support at least one sensitive layer composed of plural silver halide emulsion layers each having a substantially same color sensitivity but having a different light sensitivity. The light-sensitive layer is a unit light-sensitive layer having a color sensitivity to one of a blue light, a green light, and a red light, and in a multilayer silver halide color photographic material, unit light-sensitive layers are generally disposed in the order of a red-sensitive emulsion layer, a green-sensitive emulsion layer, and a blue-sensitive emulsion layer from the support side. However, according to the purpose, the foregoing disposition order of the unit light-sensitive layers may be reversed or the dispositon order that a different light-sensitive emulsion layer is disposed between the light-sensitive emulsion layers each having a same color sensitivity can be employed. Also, a light-insensitive layer may be formed between the foregoing light-sensitive layers, on the uppermost layer, and/or under the lowermost layer.

These layers described above may contain couplers described below, DIR compounds, color mixing inhibitors, etc.

As plural silver halide emulsion layers constituting each unit light-sensitive layer, it is preferred that two layers of a high-speed emulsion layer and a low-speed emulsion layer are disposed in such a manner that the light-sensitivity of them becomes successively lower towards the support as described in German Patent 1,121,470 or British Patent 923,045. Also, a low-speed emulsion layer may be disposed at the side farther from the support and a high-speed emulsion layer may be disposed at the side near the support as described in JP-A-57-112751, JP-A-62-200350, JP-A-62-206541, and JP-A-62-206543.

In practical examples, the silver halide emulsion layers can be disposed on the support in the order of a low-speed blue-sensitive emulsion layer (BL)/a high-speed blue-sensitive (BH)/a high-speed green-sensitive emulsion layer (GH)/a low-speed green-sensitive emulsion layer (GL)/a high-speed red-sensitive emulsion layer (RH)/a low-speed red-sensitive emulsion layer (RL), in the order of BH/BL/GL/GH/RH/RL, or in the order of BH/BL/GH/GL/RL/RH.

Also, they can be disposed in the order of a blue-sensitive emulsion layer/GH/RH/GL/RL from the farthest side of the support as described in JP-B-55-34932. Furthermore, they can also be disposed in the order of a blue-sensitive emulsion layer/GL/RL/GH/RH from the farthest side of the support as described in JP-A-56-25738 and JP-A-62-63936.

Also, a three-layer structure composed of a light-sensitive silver halide emulsion layer having the highest light sensitivity as the upper layer, a light-sensitive silver halide emulsion layer having a lower light sensitivity than the upper layer as an inter layer, and a silver halide emulsion layer having a far lower light sensitivity than the inter layer as the lower layer, i.e., the light sensitivity is successively lowered towards the support as described in JP-B-49-15495 can be used. Even in the case composed of three layers each having a different light sensitivity, the layers may be disposed in the order of the medium-speed emulsion layer/the high-speed emulsion layer/the low-speed emulsion layer from the farthest side from the support in a same color-sensitive layers as described in JP-A-59-202464.

In other examples, the light-sensitive emulsion layers may be disposed in the order of the high-speed emulsion layer/the low-speed emulsion layer/the medium-speed emulsion layer or in the order of the low-speed emulsion layer/the medium-speed emulsion layer/the high-speed emulsion layer. Also, when the unit light-sensitive layer is composed of four or more layers, the disposition of these layers may be changed as described above.

For improving the color reproducibility, it is preferred to dispose a donor layer (CL) of an interlayer effect having a different spectral sensitivity distribution from the main light-sensitive layer such as BL, GL, RL, etc., adjacent to or near the main light-sensitive layer as described in U.S. Pat. Nos. 4,663,271, 4,705,744, and 4,707,436, JP-A-62-160448, and JP-A-63-89850.

The silver halide which is preferably used in the present invention is silver iodobromide, silver iodochloride, or silver iodochloro-bromide each containing not more than about 30 mole% silver iodide. Silver iodobromide or silver iodochloro-bromide containing from about 2 mole % to about 10 mole % silver iodide is particularly preferred.

The silver halide grains in the photographic silver halide emulsion being used in this invention may have a regular crystal form such as cubic, octahedral, tetradecahedral, etc., an irregular crystal form such as spherical, tabular, etc., a crystal form having a crystal defect such as twin planes, or a composite form of them.

The grain sizes of the silver halide may be fine grains having not larger than about 0.2 μm or large size grains having a projected area diameter of up to about 10 μm. Also, the silver halide emulsion may be a polydisperse emulsion or a monodisperse emulsion.

The silver halide photographic emulsions being used in the present invention can be prepared using the methods described, e.g., in *Research Disclosure* (hereinafter, is referred to as RD), No. 17643 (December, 1978) pages 22 to 23, "I. Emulsion Preparation and Types"; RD, No. 18716 (November, 1979), page 648; RD, No. 307105 (November, 1989), pages 863 to 865; P. Glafkides, *Chemie et Phosique Photorgaphique*, Paul Montel, 1967; G. F. Duffin, Photographic Emulsion Chemistry, Focal Press, 1966; and V. L. Zelikman et al., *Making and Coating Photographic Emulsion*, Focal Press, 1964.

The monodisperse emulsions described in U.S. Pat. Nos. 3,574,628 and 3,655,394 and British Patent 1,413,748 can be preferably used in this invention.

Also, tabular silver halide grains having an aspect ratio of at least about 3 can be used in the present invention.

The tabular silver halide grains can be easily prepared by the methods described in Gutoff, *Photographic Science and Engineering*, Vol. 14, pages 248 to 257(1970); U.S. Pat. Nos. 4,434,226, 4,414,310, 4,433,048, and 4,439,520 and British Patent 2,112,157.

The crystal structure may be uniform throughout the crystal grain or may be composed of a different halogen composition between the inside and the outer side portion, or may have a layer structure. Also, a silver halide having a different composition may be junctioned by an epitaxial junction or a compound other than a silver halide, such as silver rhodanate, lead oxide, etc., be junctioned. Also, a mixture of silver halide grains having various crystal forms may be used.

The silver halide emulsion being used invention may be of a surface latent image type of forming latent images mainly on the surfaces thereof, of an inside latent image type of forming latent images in the inside thereof, or of a type of forming latent images on the surface and in the inside but it is necessary that the silver halide emulsion is a negative working emulsion.

The core/shell type inside latent image type emulsion described in JP-A-63-264740 may be also used and the method of preparing the emulsion is described in JP-A-59-133542. The thickness of the shell of the core/shell type emulsion differs depending on the type of development processing, etc., but is preferably from 3 nm to 40 nm, and particularly preferably from 5 nm to 20 nm.

The silver halide emulsion which is usually physically ripened, chemically ripened, and spectrally sensitized is used. The additives which are used in these steps are described in RD, No. 17643, RD, No. 18716, and RD, No. 307105 and the corresponding portions are summarized in a table shown below.

In the photographic light-sensitive material of the present invention, 2 or more kinds of silver halide emulsions having at least one different character in the grain sizes, the grain size distribution, the halogen composition, the form of the grains, and the sensitivity of the light-sensitive silver halide emulsions can be used in a same emulsion layer as a mixture thereof.

It is preferred to apply the silver halide grains having fogged grain surfaces described in U.S. Pat. No. 4,082,553, the silver halide grains having the fogged grain inside described in U.S. Pat. No. 4,626,498 and JP-A-59-214852, or colloid silver to the light-sensitive silver halide emulsion layer(s) and/or the substantially light-insensitive hydrophilic colloid layer(s).

The silver halide grains having the fogged grain inside or the fogged surface mean silver halide grains which can be uniformly developed (non-imagewise) regardless of the unexposed portions and the exposed portions of the photographic light-sensitive material and the preparation method thereof are described in U.S. Pat. No. 4,626,498 and JP-A-59-214852.

The silver halide forming the inside nuclei of the core/shell type silver halide grains having the fogged grain inside may have a different halogen composition. As the silver halide having the fogged grain inside or the fogged surface, silver chloride, silver chlorobromide, silver iodobromide, or silver chloroiodobromide can be used.

The mean grain size of these fogged silver halide grains is preferably from 0.01 to 0.75 μm, and particularly preferably from 0.05 to 0.6 μm.

Also, the grain form may be regular grains and the silver halide emulsion may be a polydisperse emulsion but a monodisperse emulsion (at least 95% the weight or the grain number of the silver halide grains has the grain sizes within ±40% of the mean grain size is preferred.

In the present invention, it is preferred to use a light-insensitive fine grain silver halide. The light-insensitive fine grain silver halide is a fine grain silver halide which is not sensitive to light at the imagewise exposure for obtaining dye images and is not substantially developed in development processing thereof and it is preferred that the light-insensitive fine grain silver halide is not previously fogged. The fine grain silver halide has a silver bromide content of from 0 to 100 mole % and, if necessary, may contain silver chloride and/or silver iodide. The fine grain silver halide preferably contains from 0.5 to 10 mole % silver iodide. The mean grain size (the mean value of the circle-equivalent diameters of the projected area) of the fine grain silver halide is preferably from 0.01 to 0.5 μm, and more preferably from 0.02 to 0.2 μm.

The fine grain silver halide can be prepared by the method same as the method of preparing ordinary light-sensitive silver halides. The surface of the silver halide grains is unnecessary be optically sensitized or a spectral sensitization is also unnecessary. In this case, however, it is preferred that a known stabilizer such as a triazole compound, an azaindene compound, a benzothiazolium compound, a mercapto compound, or a zinc compound is added to a coating liquid before adding the fine grain silver halide to the coating liquid. Also, the fine grain silver halide-containing layer can contain colloid silver.

The coated silver amount of the photographic light-sensitive material of the present invention is preferably not more than 6.0 g/m$^2$, and most preferably not more than 4.5 g/m$^2$.

The photographic additives which can be used in the present invention are described in RDs and the relates portions are shown in the following table.

| Kind of Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | — | p. 648, RC | — |
| 3. Spectral Sensitizer, Super Sensitizer | pp. 23–24 | p. 648, RC to p. 649, RC | pp. 866–868 |
| 4. Brightening Agent | p. 24 | p. 647, RC | p. 868 |
| 5. Light Absorber, Filter Dye, UV Absorber | pp. 25–26 | p. 649, RC to p. 650, left column (LC) | p. 873 |
| 6. Binder | p. 26 | P. 651, LC | pp. 873–874 |
| 7. Plasticizer, Lubricant | p. 27 | p. 650, RC | p. 876 |
| 8. Coating Aid, Surfactant | pp. 26–27 | p. 650, RC | pp. 875–876 |
| 9. Antistatic Agent | p. 27 | p. 650, RC | pp. 876–877 |
| 10. Matting Agent | — | — | pp. 878–879 |

For the photographic light-sensitive materials of the present invention, various dye-forming couplers can be used but the following couplers are particularly preferred.

Yellow Coupler:

There are the couplers shown by the formulae (I) and (II) described in European Patent 502,424A; the couplers shown by the formulae (1) and (2) described in European Patent 513,496A (in particular, Y-28 on page 18); the couplers shown by the formula (I) described in claim 1 of European Patent 568,037 A; the couplers shown by the formula (I) of lines 45 to 55 in column 1 of U.S. Pat. No. 5,066,576; the couplers shown by the formula (I) described in JP-A-4-274425; the couplers described in claim 1 in page 40 of European Patent 498,381 A1 (in particular, D-35 on page 18); the couplers shown by the formula (Y) (in particular, Y-1 on page 17 and Y-54 on page 41); and the couplers shown by formulae (II) to (IV) described in column 7, lines 36 to 58 of U.S. Pat. No. 4,476,219 (in particular, II-17 and II-19 (column 17) and II-24 (column 19)).

Magenta Coupler:

There are the couplers L-57 (page 11, right lower column), L-68 (page 12, right lower column), and L-77 (page 13, right lower column) described in JP-A-3-39737; the couplers (A-4)-63 (page 134), (A-4)-73 and (A-4)-75 (page 139) described in European Patent 456,257; the couplers M-4, M-6 (page 26), and M-7 (page 27) described in European Patent 486,965; the coupler M-45 described in page 19 in European Patent 571,959 A; the coupler M-1 described in pagen 6 in JP-A-5-204106; and the coupler M-22 (paragraph 0237) described in JP-A-4-362631.

Cyan Coupler:

There are the couplers CX-1, -3. -4, -5, -11, -12, -14, and -15 (pages 14 to 16) described in JP-A-4-204843; the couplers C-7, C-10 (page 35), C-34. C-35 (page 37), (I-1), and (I-17) (pages 42 to 43) described in JP-A-4-43345; and the couplers shown by the formulae (Ia) and (Ib) described in claim 1 of JP-A-6-67385:

Polymer coupler:

There are Couplers P-1 and P-5 described in page 11 in JP-A-2-44345.

As the coupler giving a colored dye having a proper diffusibility, the couplers described in U.S. Pat. No. 4,366,237, British Patent 2,125,570, European Patent 96,570, and German Patent 3,234,533 are preferably used in the present invention.

As the coupler for correcting the unnecessary absorption of the colored dye, the yellow colored cyan couplers shown by the formulae (CI), (CII), (CIII), and (CIV) described in page 5 in European Patent 456,257A1 (especially YC-86 in page 84); the yellow colored magenta couplers ExM-7 (page 202), Ex-1 (page 249), and EX-7 (page 251) described in European Patent 456,257A1; the magenta colored cyan couplers CC-9 (column 8) and CC-13 (column 10) described in U.S. Pat. No. 4,833,069; the coupler (2) (column 8) described in U.S. Pat. No. 4,837,136; and the colorless masking couplers shown by the formula (A) described in claim 1 of WO 92/11575 are preferred (especially exemplified compounds in pages 36 to 45).

As the compounds (including couplers) each releasing a photographically useful compound by causing a reaction with the oxidized product of a color developing agent, there are following compounds.

Development Inhibitor-Releasing Compound:

There are the compounds (in particular, T-101 (page 30), T-104 (page 31), T-113 (page 36), T-131 (page 45), T-144 (page 51), and T-158 (page 58)) shown by the formulae (I), (II), (III), and (IV) described in European Patent 378,236A1; the compounds (in particular D-49 (page 51)) shown by the formula (I) described in page 7 of European Patent 436,938A2; the compounds (in particular, compound (23) (page 11)) shown by the formula (I) described in European Patent 568,037A; and the compounds (in particular, the compound I-(1)in page 29) shown by the formulae (I), (II), and (III) described in pages 5 to 6 of European Patent 440,195A2.

Bleach Accelerator-Releasing Compound:

There are the compounds (in particular, the compounds (60) and (61)in page 61) shown by the formulae (I) and (I') described in page 5 of European Patent 310,125A2; and the compounds (in particular, the compound (7) in page 7) shown by the formula (I) described in claim 1 of JP-A-6-59411.

Ligand-Releasing Compound:

There are the compounds (in particular, the compounds described in column 12, lines 21 to 41) shown by LIG-X described in claim 1 of U.S. Pat. No. 4,555,478.

Leuco Dye-Releasing Compound:

There are the compounds 1 to 6 described in columns 3 to 8 of U.S. Pat. No. 4,749,641.

Fluorescent Dye-Releasing Compound:

There are the compounds (in particular, the compounds 1 to 11 of columns 7 to 10) shown by Coup-Dye described in claim 1 of U.S. Pat. No. 4,774,181.

Development Accelerator- or Fogging Agent-Releasing Compound:

There are the compounds (in particular, the compound (I-22) of column 25) shown by the formulae (1), (2), and (3) described in column 3 of U.S. Pat. No. 4,656,123, and the compounds shown by ExZK-2 described in page 75, lines 36–38 of European Patent 450,637 A2.

Compound releasing a group which becomes a dye by being released:

There are the compounds (in particular, the compounds Y-1 to Y-19 in columns 25 to 36) shown by the formula (I) described in claim 1 of U.S. Pat. No. 4,857,447.

As other additives than couplers, the following compounds are preferred.

Dispersion Medium for Oil-Soluble Organic Compound:

There are the compounds P-3, -5, -16, -19, -25, -30, -42, -49, -54, -55, -66, -81, -85, -86, and -93 described pages 140 to 144 in JP-A-62-215272.

Latex Being Impregnated With Oil-Soluble Organic Compound:

There are the latexes described in U.S. Pat. No. 4,199,363.

Scavenger for Oxidized Product of Developing Agent:

There are the compounds <in particular, the compounds I-(1), -(2), -(6), and -(12) (columns 4 to 5)) shown by the formula (I) described in column 2, lines 54 to 62 in U.S. Pat. No. 4,978,606 and the compounds (in particular, the compound 1 in column 3) shown by the formulae described in column 2, lines 5 to 10 of U.S. Pat. No. 4,923,787.

Stain Inhibitor:

There are compounds shown by formulae (I) to (III) in page 4, lines 30 to 33 (in particular I-47, -72, III-1, -27 in pages 24 to 28) in European Patent 298321 A Discoloration Inhibitor:

There are the compounds A-6, -7, -20, -21, -23, -24, -25, -26, -30, -37, -40, -42, -48, -63, -90, -92, -94, and -164 (in pages 69 to 118) described in European Patent 298,321A, the compounds II-1 to III-23 (in particular, the compound III-10) described in columns 25 to 38 of U.S. Pat. No. 5,122,444, the compounds I-1 to III-4 (in particular, the compound II-2) described in pages 8 to 12 in European Patent 471,347A, and the compounds A-1 to A-48 (in particular, the compounds A-39 and A-42) described in columns 32 to 40 of U.S. Pat. No. 5,139,931.

Material for reducing the using amount of coloring intesifier or color mixing inhibitor:

There are the compounds I-1 to II-15 (in particular, the compound (I-46) described in pages 5 to 24 in European Patent 411,324A.

Formalin Scavenger:

There are the compounds SCV-1 to SCV-28 (in particular, the compound SCV-8) described in pages 24 to 29 in European Patent 477,932A.

Hardening Agent:

There are the compounds H-1, -4, -6, -8, and -14 described in page 17 in JP-A-1-214845, the compound H-1 to H-54 shown by the formulae (VII) to (XII) described in columns 13 to 23 of U.S. Pat. No. 4,618,573, the compounds H-1 to H-76 (in particular, the compound H-14) shown by the formula (6) described in page 8, right lower column in JP-A-2-214852, and the compounds described in claim 1 of U.S. Pat. No. 3,325,287.

Development Restrainer Precursor:

There are the compounds P-24, -37, and -39 described in pages 6 to 7 in JP-A-62-168139 and the compounds described in claim 1 (in particular, the compounds 28 and 29 in column 7) of U.S. Pat. No. 5,019,492.

Antiseptics, Antifungal Agent:

There are the compounds I-1 to III-43 (in particular, the compounds II-1, II-9, II-10, II-18 and III-25) described in columns 3 to 15 of U.S. Pat. No. 4,923,790.

Stabilizer, Antifoggant:

There are compounds I-1 to (14), in particular I-1, 60, (2) and (13) disclosed in columns 6 to 16 in U.S. Pat. No.

4,923,793, and the compounds 1 to 65 (in particular, the compound 36) described in columns 25 to 32 of U.S. Pat. No. 4,952,483.

Chemical Sensitizer:

There are triphenylphosphine selenide, and the compound 50 described in JP-A-5-40324.

Dye:

There are the compounds a-1 to b-20 (in particular, the compounds a-1, -12, -18, -27, -35, and -36, b-5) in pages 15 to 18 and the compounds V-1 to V-23 (in particular, the compound V-1) in pages 7 to 29 in JP-A-3-156450, the compounds F-I-1 to F-II-43 (in particular, the compounds F-1-11 and F-II-8) described in pages 33 to 55 in European Patent 445,627A, the compounds III-1 to III-36 (in particular, the compounds III-1 and III-3) described in pages 17 to 28 in European Patent 457,153A, the fine crystal dispersions of dye-1 to dye-124 described in pages 8 to 26 in WO 88/04794, the compounds 1 to 22 (in particular, the compound 1) described in pages 6 to 11 in European Patent 319,999A, the compounds D-1 to D-87 (pages 3 to 28) shown by the formulae (1) to (3) described in European Patent 519,306A, the compounds 1 to 22 (columns 3 to 10) shown by the formula (I) described in U.S. Pat. No. 4,268,622, and the compounds (1) to (31) (columns 2 to 9) shown by the formula (I) described in U.S. Pat. No. 4,923,788.

UV Absrober:

There are the compounds (18b) to (18r), the compounds 101 to 427 (pages 6 to 9) shown by the formula (1) described in JP-A-46-3335, the compounds (3) to (66) (page 10 to 44) shown by the formula (I) and the compounds HBT-1 to HBT-10 (page 14) shown by the formula (III) described in European Patent 520,938A, and the compounds (1) to (31) (column 2 to 9) shown by the formula (1) described in European Patent 521,823A.

The present invention can be applied to various color photographic light-sensitive materials such as general or cinne color negative photographic films, color reversal photographic films for slide or television, color photographic papers, color positive photographic films, and color reversal photographic papers. Also, the present invention is suitably applied to film units with lens described in JP-B-2-32615 and JU-B-3-39784 (the term "JU-B" as used herein means an "examined published Japanese utility model application").

Proper supports which can be used in the present invention are described in RD, No. 17643, page 28, RD, No. 18716, page 647, right column to page 648, left column, and RD, No. 307105, page 879.

In the photographic light-sensitive material of the present invention, the sum total of the thickness of the total hydrophilic colloid layers at the side having silver halide emulsion layers is preferably not thicker than 28 μm, more preferably not thicker than 23 μm, far more preferably not thicker than 18 μm, and particularly preferably not thicker than 16 μm. Also, the film swelling speed $T_{1/2}$ is preferably not faster than 30 seconds, and more preferably not faster than 20 seconds. In this invention, $T_{1/2}$ is defined the time that the film thickness reaches ½ of a saturated film thickness when the photographic light-sensitive material is processed in a color developer for 3 minutes and 15 seconds at 30° C., 90% of the maximum swelled film thickness is defined as the saturated film thickness. The film thickness means the film thickness measured under 25° C. and 55% in relative humidity (2 days) and $T_{1/2}$ can be measured by using a swellometer of the type described in A. Green et al., *Photographic Science and Engineering*, Vol. 19, 2, pages 124 to 129. $T_{1/2}$ can be controlled by adding a hardening agent to gelatin as a binder or by changing the time passing condition after coating.

Also, the swelling ratio is preferably from 150 to 400%. The swelling ratio can be calculated by the equation (A-B)/B (wherein A is the maximum swelled film thickness and B is a film thickness) from the maximum swelled film thickness under the condition described above.

In the photographic light-sensitive material of the present invention, it is preferred to form a hydrophilic colloid layer having the sum total of the dry thickness of from 2 to 20 μm on the opposite side of the support to the side having the silver halide emulsion layer(s) (hereinafter, this hydrophilic colloid layer is referred to as a back layer). It is preferred that the back layer contains the light absorber, the filter dye, the UV absorber, the antistatic agent, the hardening agent, the binder, the plasticizer, the lubricant, the coating aid, and/or the surface active agent described above.

The swelling ratio of the back layer is preferably from 150 to 500%.

The photographic light-sensitive material of the present invention can be processed by the ordinary process described in RD, No. 17643, pages 28 to 29, RD, No. 18716, page 651, left column to right column, and RD, No. 307105, pages 880 to 881.

The color developer which is used for developing the photographic light-sensitive material of the present invention is an alkaline aqueous solution of, preferably, an aromatic primary amino color developing agent as the main component. As the color developing agent, an aminophenol compound is also useful but a p-phenylenediamine compound is preferably used and as the specific and preferred example thereof, there are the compounds described in European Patent 556,700A, page 28, lines 43 to 52. These compounds can be used as a mixture of two or more kinds according to the purpose.

The color developer generally contains a pH buffer such as alkali metal carbonates, borates, or phosphates and a development restrainer or an antifogging agent, such as chlorides, bromides, iodides, benzimidazoles, benzothiazoles, and mercapto compounds. If desired, hydrazines such as hydroxylamine, diethylhydroxylamine sulfites, N,N-bis-carboxymethylhydrazine, etc.; various preservatives such as phenylsemicarbazides, triethanolamine, catecholsulfonic acids, etc.; organic solvents such as ethylene glycol, diethylene glycol, etc.; development accelerators such as benzyl alcohol, polyethylene glycol, quaternary ammonium salts, amines, etc.; dye-forming couplers; competing couplers; auxiliary developing agents such as 1-phenyl-3-pyrazolidone, etc.; tackifiers; various chelating agents such as aminopolycarboxylic acids, aminopolysulphosphonic acid, alkylphosphonic acids, phosphonocarboxylic acids, etc. for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and the salts of them are added to the color developer.

In the case of practicing reversal processing, usually, after carrying out a black and white development, a color development is carried out. For the black and white development, known black and white developing agents such as dihydroxybenzenes (e.g., hydroquinone), 3-pyrazolidones (e.g., 1-phenyl-3-pyrazolidone), and aminophenols (e.g., N-methyl-p-aminophenol) can be used singly or as a combination thereof.

The pH of the color developer and the black and white developer is generally from 9 to 12. Also, the replenishing amount for these developers depends upon the kind of the color photographic light-sensitive material to be processed but is generally not more than 3 liters per square meter of the photographic light-sensitive material and by reducing the bromide ion concentration in the replenisher, the replenishing amount can be reduced below 500 ml. In the case of reducing the replenishing amount, it is preferred to prevent the occurrences of the evaporation of the liquid and the air oxidation of the developer by reducing the contact area of the processing tank and air.

The processing effect by the contact of a photographic processing liquid with air in a processing tank can be evaluated by an opening ratio (=[contact area ($cm^2$) of processing liquid with air]÷[volume ($cm^3$) of the processing liquid]). The opening ratio is preferably 0.1 or lower, and more preferably from 0.001 to 0.05.

As a method of reducing the opening ratio, there are, in addition to the method of placing a cover such as a floating lid, etc., on the surface of the photographic processing liquid in a processing tank, the method of using a movable lid described in JP-A-1-82033 and the slit development processing method described in JP-A-63-216050.

It is preferred that the opening ratio is reduced not only in the steps of the color development and the black and white development but also in the subsequent various steps of, e.g., bleach, bleach-fix (blix), fix, wash, stabilization, etc.

Also, by using a method of restraining the accumulation of bromide ions in a developer, the replenishing amount can be reduced.

The time for the color development is usually from 2 to 5 minutes but by increasing the temperature and pH and increasing the concentration of a color developing agent, the processing time can be more shortened.

After color development, the photographic light-sensitive material is usually subjected to bleach processing. The bleach processing may be carried out simultaneously with fix processing (blix processing) or may be carried out separately from fix processing. Furthermore, for quickening processing, a processing method of carrying out blix processing after bleach processing may be employed. Furthermore, a process of carrying out blix processing by two tanks, a process of carrying out fix processing before blix processing, or a process of carrying out bleach processing after blix processing can be practiced according to the purposes.

As the bleaching agent, a compound of a polyvalent metal such as iron(III), a peroxide, a quinone, a nitro compound, etc., is used. As the typical bleaching agent, organic complex salts of iron (III), for example, the complex salts with aminopolycarboxylic acids (such as, ethylenediaminetetraacetic acid, diethylenetriaminepentaacetic acid, cyclohexanediaminetetraacetic acid, methyliminodiacetic acid, 1,3-diaminipropanetetraacetic acid, glycol ether diaminetetraacetic acid, etc.), citric acid, tartaric acid, malic acid, etc., can be used. In these complex salts, aminopolycarboxylic acid iron(III) complex salt such as ethylenediaminetetraacetic acid iron(III) complex salt and 1,3-diaminopropanetetraacetic acid iron(III) complex salt is preferred from the view points of quick processing and the prevention of an environmental pollution. Furthermore, the aminopolycarboxylic acid iron(III) complex salt is particularly useful for a bleach liqiud and a blix liquid.

The pH of the bleach liquid or the blix liquid using the aminopolycarboxylic acid iron(III) complex salt is usually from 4.0 to 8 but the pH can be more lowered for quickening processing.

For the bleach liquid, the blix liquid, and the prebath thereof, if desired, a bleach accelerator can be used. Specific examples of the useful bleach accelerator are shown below.

That is, there are the compounds having a mercapto group or a disulfide group described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD, No.17129 (July, 1978); the thiazolidine derivatives described in JP-A-50-140129; the thiourea derivatives described in JP-B-45-8506, JP-A-52-20832, JP-A-53-32735, and U.S. Pat. No. 3,706,561; the iodides described in German Patent 1,127,715 and JP-A-58-16235; the polyoxyethylene compounds described in German Patents 966,410 and 2,748,430; the polyamine compounds described in JP-B-45-8836; the compounds described in JP-A-49-40943, JP-A-49-59644, JP-A-53-94927, JP-A-54-35727, JP-A-55-26506, and JP-A-58-163940, and bromide ions.

In these compounds, the compounds having a mercapto group or a disulfide group are preferred from the view point of giving a large acceleration effect. Compounds disclosed in U.S. Pat. No. 3,893,858, German Patent 1,290,812 and JP-A-53-95,630 are preferred. Furthermore, the compounds described in U.S. Pat. No. 4,552,834 are also preferred.

These bleach accelerators may be added into the photographic light-sensitive materials. When a color photographic light-sensitive material for photographing is blixed, these bleach accelerators are particularly effective.

It is preferred that the bleach liquid or the blix liquid contains an organic acid for the purpose of preventing the occurrence of a bleach stain in addition to the above-described compounds. The particularly preferred organic acid is a compound having an acid dissociation constant (pKa) of from 2 to 5 and specifically, acetic acid, propionic acid, hydroxyacetic acid, etc., are preferred.

As a fixing agent being used for the fix liquid or the blix liquid, there are thiosulfates, thiocyanates, thioether compounds, thioureas, a large amount of iodides, etc., but the use of a thiosulfate is general and in particular, ammonium thiosulfate can be used in the most wide range. The use of a thiosulfate together with a thiocyanate, a thioether compound, or a thiourea is also preferred.

As the preservatives for the fix liquid or the blix liquid, sulfites, bisulfites, carbonyl-bisulfites addition products, and the sulfinic acid compounds described in European Patent 294,769A are preferably used. Furthermore, for the fix liquid or the blix liquid, the addition of an aminopolycarboxylic acid or an organic phosphonic acid is preferred for the purpose of stabilizing the liquid.

In the present invention, it is preferred to add a compound having pKa of from 6.0 to 9.0, preferably an imidazole such as imidazole, 1-methylimidazole, 1-ethylimidazole, 2-methylimidazole, etc., to the fix liquid or the blix liquid in an amount of from 0.1 to 10 moles per liter of the liquid for controlling the pH of the liquid.

The sum total of the time for the desilvering steps is preferably shorter in the range of not causing inferior desilvering. The time is preferably from 1 minute to 3 minutes, and more preferably from 1 minute to 2 minutes.

Also, the processing temperature is from 25° C. to 50° C., and preferably from 35° C. to 45° C. In the preferred temperature range, the desilvering speed is improved and the occurrence of stains after processing can be effectively prevented.

In the desilvering steps, it is preferred that stirring is strengthened as strong as possible. As a practical method of strengthening stirring, there are the method of striking the emulsion surface of the photographic light-sensitive material with the jet stream of the processing liquid described in JP-A-62-183460, the method of increasing the stirring effect using a rotation means described in JP-A-62-183461, the method of improving the stirring effect by moving the photographic light-sensitive material while contacting the emulsion surface with a wiper blade equipped in the liqiud to cause a turbulent flow at the emulsion surface, and the method of increasing the circulating amount of the whole processing liquid. Such a stirring means is also effective for the bleach liquid, blix liquid, and the fix liquid.

It is considered that the improvement of stirring hastens the supply of a bleaching agent and/or the fixing agent into the emulsion layers, which results in increasing the desilvering speed. Also, the foregoing stirring-improving means is more effective in the case of using a bleach accelerator, whereby the acceleration effect can be greatly increased and also the fixing obstructing action by the bleach accelerator can be prevented.

It is preferred that an automatic processor being used for processing the photographic light-sensitive material of the present invention has the photographic light-sensitive material transport means as described in JP-A-60-191257, JP-A-60-191258, and JP-A-60-191259. As described in JP-A-60-191257 described above, such a transport means can greatly reduced the amount of the processing liquid carried from a pre-bath to a post-bath, gives a high effect of preventing the deterioration of the properties of the processing liquid, and is particularly effective for shortening the processing time in each step and the reduction of the replenishing amount for the processing liquid.

The photographic light-sensitive material of the present invention is generally subjected to a wash step and/or a stabilization step after desilvering processing.

The amount of wash water in the wash step can be selected in a wide range according to various factors such as the characteristics (e.g., by the using materials such as couplers, etc.) and the use of the color photographic light-sensitive material, the temperature of wash water, the number (stage number) of wash tanks, the replenishing system such as a countercurrent system or a normal current system, etc.

In these factors, the relation of the number of wash tanks and the amount of water can be determined by the method described in *Journal of the Society of Motion Picture and Television Engineers*, Vol. 64, pages 248–253(May, 1955). According to the multistage countercurrent system described in the above publication, the amount of wash water can be greatly reduced but by the increase of the residence time of water in the tanks, bacteria grow to cause a problem that floats formed attach to the photographic light-sensitive material processed. As a counterplan for solving the problem, the method of reducing calcium ions and magnesium ions described in JP-A-62-288838 is very effective. Also, the isothiazolone compounds described in JP-A-57-8542, thiabendazoles, chlorine-containing fungicides such as chlorinated sodium isocyanuric acid, etc., benzotriazoles, and the fungicides described in Hiroshi Horiguchi, *Bokin Bobai Zai no Kagaku* (*Chemistry of Antibacterial and Antifungal Agents*), published by Sankyo K. K.; *Biseibutsu no Mekkin, Sakkin, Boubai Gijyutsu* (*Sterilization and Antifungal Technique of Microorganisms*), published by Kogyo Gijyutsu Kai, 1982; and *Bokin Bobai Zai Jiten* (*Antibacterial and Antifungal Agent Handbook*), 1986 can be used.

The pH of wash water in processing of the photographic light-sensitive material of this invention is from 4 to 9, and preferably from 5 to 8. The temperature of wash water and the washing time can be suitably selected according to the characteristics and the use of the photographic light-sensitive material but are generally selected in the ranges of from 15° C. to 45° C. and from 20 seconds to 10 minutes, and preferably from 25° C. to 40° C. and from 30 seconds to 5 minutes.

Furthermore, the photographic light-sensitive material of this invention can be directly processed by a stabilization liquid in place of wash water. In such stabilization processing, the known processes described in JP-A-57-8543, JP-A-58-14834, and JP-A-60-220345 can be applied.

Also, as the case may be, after wash processing described above, stabilization processing is further carried out and as an example, there is a stabilization bath containing a dye stabilizer and a surface active agent being used as the final bath for processing a color photographic light-sensitive material for photographing. As the dye stabilizer, there are aldehydes such as formalin, glutaraldehyde, etc., N-methylol compounds, hexamethylenetetramine, and aldehyde-sulfite addition products. To the stabilization bath can be added various chelating agents and antifungal agents.

The overflow liquid with replenishing wash water and/or the stabilization liquid described above can be reutilized for the desilvering steps, etc.

In the processing using an automatic processor, etc., when each processing liquid is concentrated by evaporation, it is preferred to add water for correct the concentrated liquid.

The photographic light-sensitive material of the present invention may contain therein a color developing agent for simplifying and quickening processing. In this case, for incorporating a color developing agent to the photographic light-sensitive material, it is preferred to use a precursor of the color developing agent. As such a precursor, there are, for example, the indoaniline compounds described in U.S. Pat. No. 3,342,597; the Schiff base-type compounds described in U.S. Pat. No. 3,342,599, RD, No.14,850, and RD, No. 15159; the aldol compounds described in RD, No. 13924; the metal salt complexes described in U.S. Pat. No. 3,719,492; and the urethane compounds described in JP-A-53-135628.

The color photographic light-sensitive material of this invention may, if necessary, contain therein a 1-phenyl-3-pyrazolidone for accelerating the color development. Typical examples of the compound are described in JP-A-56-64339, JP-A-57-144547, and JP-A-58-115438.

The processing liquids used for processing the photographic light-sensitive material of the present invention are used at a temperature of from 10° C. to 50° C. Usually, a temperature of from 33° C. to 38° C. is standard but by increasing the temperature, the processing is accelerated to shorten the processing time or by lowering the processing temperature, the image quality can be improved and also the stability of the processing liquids can be improved.

Then, the following examples are intended to illustrate the present invention more practically but not to limit the invention in any way.

EXAMPLE 1

A single layer photographic light-sensitive material (Sample 101) having the following structure was prepared by coating a silver halide emulsion layer on a triacetyl cellulose support having a subbing layer.

| | Amount |
|---|---|
| Green-Sensitive Silver halide Emulsion Layer | |
| Silver Iodobromide emulsion (average silver iodide content: 6.4%, mean grain size (sphere-equivalent diameter): 0.61 μm, variation coeff. of grain sizes: 14%, aspect ratio: 5.5) | 2.40 g/m$^2$ Ag |
| Magenta Coupler M-1 | 0.300 g/m$^2$ |
| Colored Magenta Coupler M-2 | 0.050 g/m$^2$ |
| DIR Coupler D-1 | 0.018 g/m$^2$ |
| DIR Coupler D-2 | 0.015 g/m$^2$ |
| DIR Coupler D-3 | 0.060 g/m$^2$ |
| Tricresyl Phosphate | 0.39 g/m$^2$ |
| Color Development | 0.012 g/m$^2$ |

-continued

| | Amount |
|---|---|
| Accelerator K-1 | |
| Sensitizing Dye S-1 | $5.00 \times 10^{-5}$ |
| Sensitizing Dye S-2 | $3.44 \times 10^{-4}$ |
| Sensitizing Dye S-3 | $1.31 \times 10^{-3}$ |
| Gelatin | 3.00 g/m$^2$ |
| Gelatin Protective Layer | |
| Gelatin | 2.00 g/m$^2$ |
| Hardening Agent H-1 | 0.12 g/m$^2$ |

The addition amount of the sensitizing dye was shown by a mole ratio to 1 mole of silver.

The structures of the compounds used above are as follows.

M-1

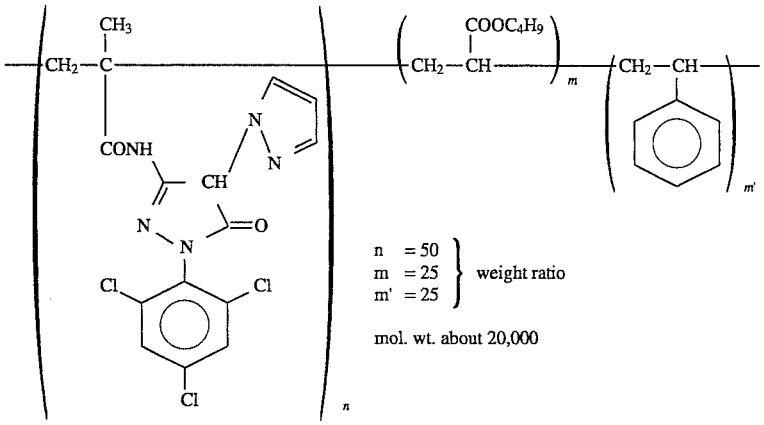

M-2

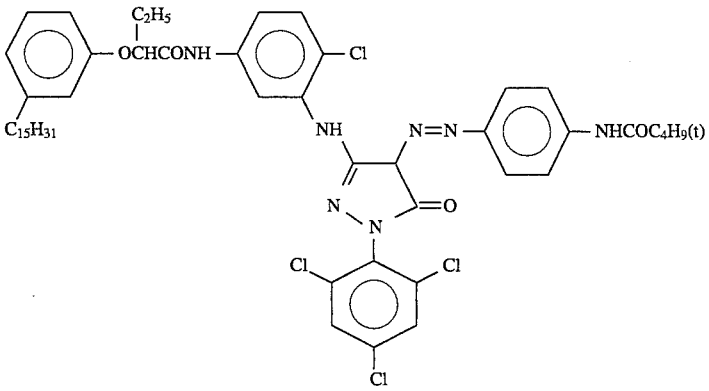

D-1

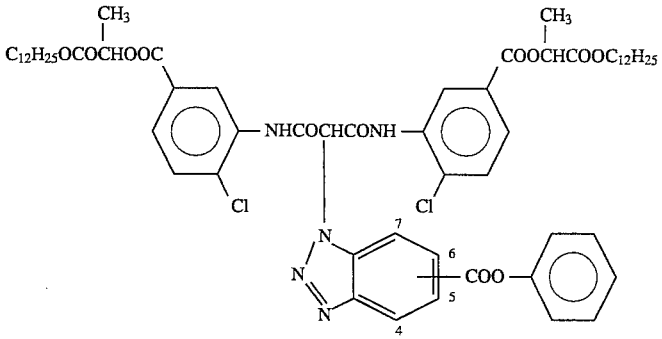

(a mixture of the compounds having the substituent at 5- and 6- positions: the same herein after)

-continued

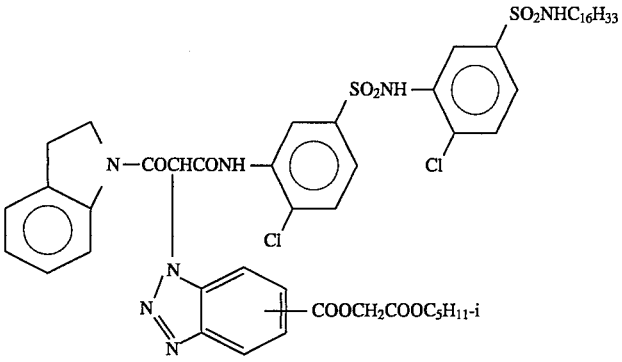

D-2

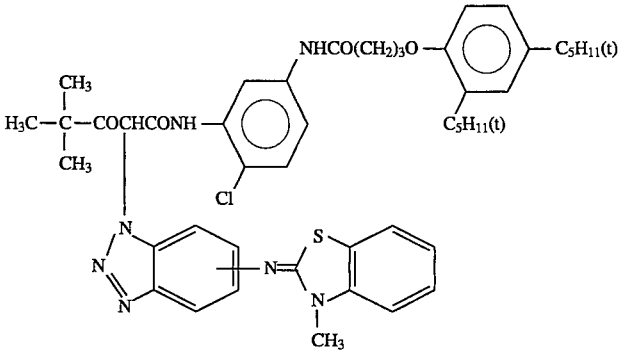

D-3

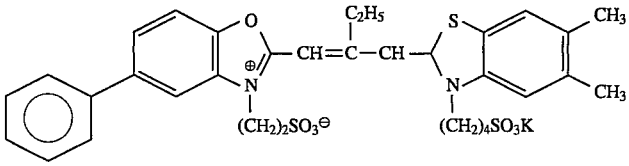

S-1

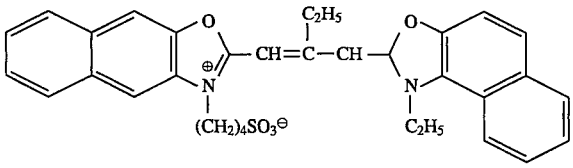

S-2

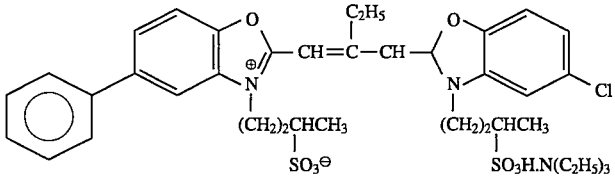

S-3

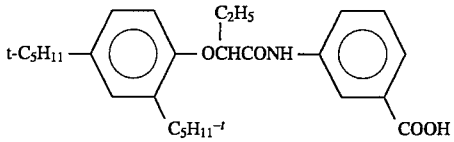

K-1

$(CH_2{=}CH{-}SO_2CH_2CONHCH_2)_2$

H-1

Then, by following the same procedure as the case of preparing sample 101 except that each of the compounds of this invention and the comparative compounds shown in Table 2 below, samples 102 to 130 were prepared. In addition, the compound was added to the coating liquid as a 2% methanol solution thereof.

TABLE 2

| Sample No. | Additive | Amount mol/mol Ag | Fog (A) | Relative Sens. | St. Fog (B) | B-A | Remarks |
|---|---|---|---|---|---|---|---|
| 101 | — | — | 0.24 | 100 | 0.49 | 0.25 | Control |
| 102 | A | $1.0 \times 10^{-4}$ | 0.23 | 98 | 0.49 | 0.26 | Com- |

TABLE 2-continued

| Sample No. | Additive | Amount mol/mol Ag | Fog (A) | Relative Sens. | St. Fog (B) | B-A | Remarks |
|---|---|---|---|---|---|---|---|
| | | | | | | | parison |
| 103 | B | $1.0 \times 10^{-4}$ | 0.11 | 63 | 0.27 | 0.16 | Comparison |
| 104 | C | $1.0 \times 10^{-4}$ | 0.09 | 58 | 0.24 | 0.15 | Comparison |
| 105 | A-1 | $1.0 \times 10^{-4}$ | 0.12 | 98 | 0.28 | 0.16 | Invention |
| 106 | A-2 | $1.0 \times 10^{-4}$ | 0.14 | 100 | 0.32 | 0.18 | Invention |
| 107 | A-3 | $1.0 \times 10^{-4}$ | 0.12 | 95 | 0.27 | 0.15 | Invention |
| 108 | A-8 | $1.0 \times 10^{-4}$ | 0.13 | 98 | 0.27 | 0.14 | Invention |
| 109 | A-9 | $1.0 \times 10^{-4}$ | 0.12 | 100 | 0.25 | 0.13 | Invention |
| 110 | A-14 | $1.0 \times 10^{-4}$ | 0.11 | 102 | 0.25 | 0.14 | Invention |
| 111 | A-15 | $1.0 \times 10^{-4}$ | 0.11 | 100 | 0.26 | 0.15 | Invention |
| 112 | A-25 | $1.0 \times 10^{-4}$ | 0.13 | 98 | 0.28 | 0.15 | Invention |
| 113 | A-26 | $1.0 \times 10^{-4}$ | 0.12 | 100 | 0.28 | 0.16 | Invention |
| 114 | A-33 | $1.0 \times 10^{-4}$ | 0.14 | 98 | 0.29 | 0.15 | Invention |
| 115 | A-37 | $1.0 \times 10^{-4}$ | 0.15 | 100 | 0.31 | 0.16 | Invention |
| 116 | A-38 | $1.0 \times 10^{-4}$ | 0.15 | 100 | 0.32 | 0.17 | Invention |
| 117 | A-39 | $1.0 \times 10^{-4}$ | 0.17 | 98 | 0.31 | 0.14 | Invention |
| 118 | A-41 | $1.0 \times 10^{-4}$ | 0.13 | 98 | 0.26 | 0.13 | Invention |
| 119 | A-42 | $1.0 \times 10^{-4}$ | 0.16 | 95 | 0.33 | 0.17 | Invention |
| 120 | A-44 | $1.0 \times 10^{-4}$ | 0.18 | 93 | 0.34 | 0.16 | Invention |
| 121 | A-1 | $1.0 \times 10^{-5}$ | 0.16 | 100 | 0.34 | 0.18 | Invention |
| 122 | A-1 | $5.0 \times 10^{-4}$ | 0.11 | 95 | 0.25 | 0.14 | Invention |
| 123 | A-4 | $1.0 \times 10^{-5}$ | 0.14 | 98 | 0.31 | 0.17 | Invention |
| 124 | A-4 | $1.0 \times 10^{-4}$ | 0.11 | 95 | 0.25 | 0.14 | Invention |
| 125 | A-26 | $1.0 \times 10^{-5}$ | 0.17 | 100 | 0.35 | 0.18 | Invention |
| 126 | A-26 | $5.0 \times 10^{-4}$ | 0.11 | 98 | 0.24 | 0.13 | Invention |
| 127 | A-33 | $1.0 \times 10^{-5}$ | 0.18 | 100 | 0.36 | 0.16 | Invention |
| 128 | A-33 | $5.0 \times 10^{-4}$ | 0.11 | 95 | 0.25 | 0.14 | Invention |
| 129 | A-37 | $1.0 \times 10^{-5}$ | 0.19 | 102 | 0.36 | 0.17 | Invention |
| 130 | A-37 | $5.0 \times 10^{-4}$ | 0.13 | 98 | 0.27 | 0.14 | Invention |

The comparative compounds A, B, and C shown in Table 2 above are as follows.

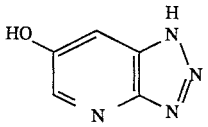

Compound A

The compounds described in JP-A-3-138639 and JP-A-4-97348.

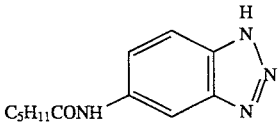

Compound B

The compound described in JP-B-60-29390.

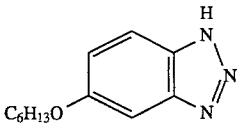

Compound C

The compound described in JP-B-60-29391.

Each of samples 101 to 130 thus prepared was cut into 2 pieces, one of the sample piece was stored in a freezer for 3 days for restraining the change of the photographic performance with the passage of time and the other was stored under the condition of 50° C. and 80% in relative humidity for 3 days for a forcible test with the passage of time.

After applying a sensitometric exposure to each sample piece using an optical wedge, the sample was processed by the following processing steps.

| Step | Processing Time | Processing Temp. | Replenishing Amount* | Tank Volume |
|---|---|---|---|---|
| Color Development | 185 seconds | 38.0° C. | 23 ml | 17 l |
| Bleach | 50 seconds | 38.0° C. | 5 ml | 5 l |
| Blix | 50 seconds | 38.0° C. | — | 5 l |
| Fix | 50 seconds | 38.0° C. | 16 ml | 5 l |
| Wash with water | 30 seconds | 38.0° C. | 34 ml | 3 l |
| Stabilization (1) | 20 seconds | 38.0° C. | — | 3 l |
| Stabilization (2) | 20 seconds | 38.0° C. | 20 ml | 3 l |
| Drying | 60 seconds | 60.0° C. | — | — |

*The replesnishing amount was per area of 35 mm width × 1.1 meters of the sample (corresponding to 24 exposures).

The stabilization was carried out by a countercurrent system of from (2) to (1) and all the overflow liquid of wash water was introduced into the fix bath. For replenishing to the blix bath, a cut was formed at the upper portion of the bleach tank of the automatic processor and at the upper portion of the fix tank of the processor such that all the overflow liquid formed by supplying each of the replenishers to the bleach tank and the fix tank flowed in the blix tank. In addition, the amount of the developer carried into the bleach step, the amount of the bleach liquid carried into the blix step, the amount of the blix liquid carried into the fix step, and the amount of the fix liquid carried into the wash step were 2.5 ml, 2.0 ml, 2.0 ml, and 2.0 ml, respectively per 35mm width×1.1 meters of the sample. Also, the crossover time was 6 seconds in each case and the time was included in the processing time of each of the former step.

As each replenisher, the same liquid as each tank liquid was used.

Then, the composition of each processing liquid is shown below.

| Color Developer | |
|---|---|
| Diethylenetriaminepentaacetic Acid | 2.0 g |
| 1-Hydroxyethylidene-1,1-diphosphonic Acid | 2.0 g |
| Sodium Sulfite | 3.9 g |
| Potassium Carbonate | 37.5 g |
| Potassium Bromide | 1.4 g |
| Potassium Iodide | 1.3 mg |
| Hydroxyamine Sulfate | 2.4 g |
| 2-Methyl-4-[N-ethyl-N-(β-hydroxyethyl)amino]-aniline Sulfate | 4.5 g |
| Water to make | 1 liter |
| pH (adjusted with potassium hydroxide and sulfuric acid) | 10.05 |
| **Bleach Liquid** | |
| 1,3-Diaminopropanetetraacetic Acid Ferric Ammonium Monohydrate | 130 g |
| Ammonium Bromide | 80 g |
| Ammonium Nitrate | 15 g |
| Hydroxyacetic Acid | 25 g |
| Acetic Acid | 40 g |
| Water to make | 1 liter |
| pH (adjusted with an aqueous ammonia) | 4.4 |
| **Blix Liquid** | |
| A mixture of the above blach liquid and the following fix liquid at 15/85 by volume ratio. (pH 7.0) | |
| **Fix Liquid** | |
| Ammonium Sulfite | 19 g |
| Ammonium Thiosulfate Aqueous Solution (700 g/liter) | 280 ml |

-continued

| | |
|---|---|
| Imidazole | 15 g |
| Ethylenediaminetetraacetc Acid | 15 g |
| Water to make | 1 liter |
| pH (adjusted with aqueous ammonia and acetic acid) | 7.4 |

Wash Water

City water was passed through a mixed bed type column filled with a H-type strong acidic cation exchange resin (Amberlite IR-120B, trade name, made by Rohm and Haas Company) and an OH-type strong basic anion exchange resin (Amberlite IR-400) to reduce the calcium and magnesium ion concentrations below 3 mg/liter and then 20 mg/liter of sodium dichloroisocyanurate and 150 mg/liter of sodium sulfate were added thereto. The pH of the solution was in the range of from 6.5 to 7.5.

| Stabilization Liquid | |
|---|---|
| Sodium p-Toluenesulfinate | 0.03 g |
| Polyoxyethylene-p-monononyl Phenyl Ether (average polymerization degree 10) | 0.2 g |
| Ethylenediaminetetraacetic Acid Disodium Salt | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH | 8.5 |

On each sample thus processed, the density was measured with green light and the characteristic curve was obtained. Then, from the characteristic curves corresponding to the sample stored in the freezer and the sample subjected to the forcible test with the passage of time, the minimum densities A and B were obtained. In this case, the value of B-A corresponds to the changed width of the fogs at the storages of them. Furthermore, from the characteristic curve corresponding to the sample stored in the freezer, a relative sensitivity was determined. That is, the difference of the exposure amount (logarithmic value) of giving the density of fog+0.2 on each sample between that on sample 101 (control sample) was numerically shown and the sensitivity of each sample was shown by the relative value to the value of sample 101 being 100. In this case, the larger value shows a higher sensitivity.

The results obtained are shown in Table 2 above.

From the results shown in Table 2, it can be seen that in the sample added with the comparative compound A, lowering of the sensitivity is less but the sample shows almost no fog restaining action. Also, it can be seen that in the sample added with the benzotriazole comparative compound B or C, each sample shows a fog restraining action but lowering of the sensitivity is extremely large. This is considered to be caused by the strong development restraining action of the benzotriazole compounds. On the other hand, it can be seen that in the samples each added with the compound of this invention, the sensitivity is not lowered or lowering is very slight if any, and the effect of preventing the occurrence of fog is obtained.

The reason for obtaining the astonishing effect by the compounds of this invention has not yet been clarified but it is assumed that the effect is obtained due to the proper pKa value (usually lower than that of benzotriazole) of the 1,2,3-triazole compound condensed with the 5-membered heterocyclic ring, the proper hydrophobic-hydrophilic property of the compound, and a proper affinity with the silver halide.

EXAMPLE 2

Using sample 101 in Example 1, the fog prevention effect by adding each of the comparative compounds described above and each of the compounds of the present invention to the developer was evaluated.

That is, each compound was dissolved in methanol and the solution was added to the color developer as used in Example 1 such that the concentration of the compound became 1 $\times 10^{-5}$ mole/liter.

The compounds used in the test are shown in Table 3 below.

TABLE 3

| Process No. | Additive | Fog | Relative Sensitivity | Remarks |
|---|---|---|---|---|
| 201 | — | 0.51 | 100 | Control |
| 202 | A | 0.48 | 102 | Comparison |
| 203 | B | 0.31 | 55 | Comparison |
| 204 | C | 0.28 | 52 | Comparison |
| 205 | A-1 | 0.33 | 110 | Invention |
| 206 | A-15 | 0.34 | 115 | Invention |
| 207 | A-17 | 0.36 | 105 | Invention |
| 208 | A-27 | 0.34 | 107 | Invention |
| 209 | A-34 | 0.41 | 102 | Invention |
| 210 | A-37 | 0.39 | 105 | Invention |
| 211 | A-40 | 0.40 | 102 | Invention |

After applying a sensitometric exposure to sample 101 using an optical wedge and the sample was developed as in Example 1 except that the temperature for the color development was changed to 45° C. and the processing time was changed to 125 seconds. By increasing the temperature of the processing system, the system became the system of easily forming fog.

On each of the samples processed, the density was measured with green light and the characteristic curve was obtained. From the characteristic curves, the fog density and the relative sensitivity were obtained as in Example 1 and the results are shown in Table 3 above.

From the results shown in Table 3, it can be said that the addition of the comparative compound A to the developer gives almost no influences. Also, it can be seen that in the case of adding the benzotriazole comparative compound B or C to the developer, the compound shows a fog restraining action but is accompanied by great lowering of the sensitivity. This is because softening of the gradation occurs by the development restraining action of the benzotriazole compound.

On the other hand, it can be seen that in the case of adding the compound of this invention to the developer, the formation of fog is restrained and the sensitivity is rather increased. This is considered to be that the increase of fog with the increase of the development temperature is effectively restrained by the addition of the compound of this invention.

EXAMPLE 3

A multilayer color photographic light-sensitive material (Sample 301) was prepared by coating each layer having the composition shown below on a cellulose triacetate film support having a subbing layer.

The main materials used for each layer are classified as follows:

| | | | |
|---|---|---|---|
| ExC: | Cayn Coupler | UV: | UV Absorber |
| ExM: | Magenta Coupler | HBS: | High-Boiling Organic Solvent |
| ExY: | Yellow Coupler | | |
| ExS: | Sensitizing Dye | H: | Gelatin Hardening Agent |

The numeral corresponding to each component shows the coated amount shown by a g/m$^2$ but shows the coated amount converted as silver about a silver halide emulsion. In this case, however, on the sensitizing dye, the coated amount to per mole of the silver halide in the same emulsion layer is shown by a mole unit.

| Sample 301 | |
|---|---|
| Layer 1 (Antihalation Layer) | |
| Black Colloid Silver | 0.09 (Ag) |
| Gelatin | 1.60 |
| ExM-1 | 0.12 |
| ExF-1 | $2.0 \times 10^{-3}$ |
| Solid Dispersed Dye ExF-2 | 0.030 |
| Solid Dispersed Dye ExF-3 | 0.040 |
| HBS-1 | 0.15 |
| HBS-2 | 0.02 |
| Layer 2 (Interlayer) | |
| Silver Iodobromide Emulsion M | 0.065 (Ag) |
| ExC-2 | 0.04 |
| Polyethyl Acrylate Latex | 0.20 (solid) |
| Gelatin | 1.04 |
| Layer 3 (Low-Speed Red-Sensitive Emulsion Layer | |
| Silver Iodobromide Emulsion A | 0.25 (Ag) |
| Silver Iodobromide Emulsion B | 0.25 (Ag) |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Layer 4 (Intermediate-Speed Red-Sensitive Emulsion Layer) | |
| Silver Iodobromide Emulsion C | 0.70 (Ag) |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Layer 5 (High-Speed Red-Sensitive Emulsion Layer) | |
| Silver Iodobromide Emulsion D | 1.40 (Ag) |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |

-continued

| Sample 301 | |
|---|---|
| ExC-7 | 0.010 |
| Cpd-2 | 0.050 |
| HBS-1 | 0.22 |
| HBS-2 | 0.050 |
| Gelatin | 1.10 |
| Layer 6 (Interlayer) | |
| Cpd-1 | 0.090 |
| Solid Dispersed Dye ExF-4 | 0.030 (solid) |
| HBS-1 | 0.050 |
| Polyethyl Acrylate latex | 0.15 |
| Gelatin | 1.10 |
| Layer 7 (Low-Speed Green-Sensitive Emulsion Layer) | |
| Silver Iodobromide Emulsion E | 0.15 (Ag) |
| Silver Iodobromide Emulsion F | 0.10 (Ag) |
| Silver Iodobromide Emulsion G | 0.10 (Ag) |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Layer 8 (Intermediate-Speed Green-Sensitive Emulsion Layer) | |
| Silver Iodobromide Emulsion H | 0.80 (Ag) |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Layer 9 (High-Speed Green-Sensiive Emulsion Layer) | |
| Silver Iodobromide Emulsion I | 1.25 (Ag) |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 (solid) |
| Gelatin | 1.33 |
| Layer 10 (Yellow Filter Layer) | |
| Yellow Colloid Silver | 0.015 (Ag) |
| Cpd-1 | 0.16 |
| Solid Dispersed Dye ExF-5 | 0.060 |
| Solid Dispersed Dye ExF-6 | 0.060 |
| Oil-Soluble Dye ExF-7 | 0.010 |
| HBS-1 | 0.60 |
| Gelatin | 0.60 |
| Layer 11 (Low-Speed Blue-Sensitive Emulsion Layer) | |
| Silver Iodobromide Emulsion J | 0.09 (Ag) |
| Silver Iodobromide Emulsion K | 0.09 (Ag) |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |

-continued

| Sample 301 | |
|---|---|
| ExY-4 | 0.020 |
| Cpd-2 | 0.10 |
| Cpd-3 | $4.0 \times 10^{-3}$ |
| HBS-1 | 0.28 |
| Gelatin | 1.20 |
| Layer 12 (High-Speed Blue-Sensitive Emulsion Layer) | |
| Silver Iodobromide Emulsion L | 1.00 (Ag) |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Layer 13 (1st Protective Layer) | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| Layer 14 (2nd Protective Layer) | |
| Silver Iodobromide Emulsion M | 0.10 (Ag) |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.70 |

Furthermore, each layer contained W-1 to 3, B-4 to 6, F-1 to 17, an iron salt, a lead salt, a gold salt, a plantinum salt, a palladium salt, an iridium salt, and a rhodium salt.

The silver halide emulsions used for preparing the above sample are shown in Table 4 below.

(2) Emulsions A to I were subjected to a gold sensitization, a sulfur sensitization, and selenium sensitization in the presence of the spectral sensitizing dye described for each light-sensitive amulsion layer and sodium thiocyanate according to the Example of JP-A-3-237450.

(3) For the preparation of the tabular silver halide grains, low-molecular weight gelatin was used according to the Example of JP-A-1-158426.

(4) On the tabular silver halide grains, the dislocation lines as described in JP-A-3-237450 were observed by a high-potential electron microscope.

(5) The emulsion L contained double structure silver halide grains containing a inside high-iodine content core described in JP-A-60-143331.

Preparation of Dispersion of Organic Solid Dispersing Dye

ExF -2 described below was dispersed by the following method. That is, 21.7 ml of water, 3 ml of an aqueous solution of 5% sodium p-octylphenoxyethoxyethoxyethanesulfonate, and 0.5 g of an aqueous solution of 5% p-octylphenoxy polyoxyethylene ether (polymerization degree 10) were placed in a 700 ml pot mill and after adding thereto 5.0 of dye ExF -2 and 500 ml of zirconium oxide beads (diameter 1 mm), the content was dispersed for 2 hours. For dispersing, a BO-type vibration ball mill manufactured by Chuo Koki K.K. was used. After dispersing, the content was took out and after adding thereto 8 g of an aqueous solution of 12.5% gelatin, the beads were removed by filtration to provide a gelatin dispersion of the dye. The mean particle size of the fine dye particles was 0.44 μm.

Similarly, solid dispersions of ExF -3, ExF -4, and ExF -6 were obtained. The mean particle sizes of the fine dye particles were 0.24 μm, 0.45 μm, and 0.52 μm, respectively. ExF -5 was dispersed by a microprecipitation dispersion method described in Example 1 of European Patent 549, 489A. The mean diameter was 0.06 μm.

TABLE 4

| Em | Mean AgI content (%) | Variation coefficient relative to the AGI (%) content among grains | Mean Grain Size (μm) (sphere-equipment diameter) | Variation coefficient relative to grain sizes (%) | Circle-equivalent Diameter Projected Area (μm) | Aspect Ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 4;

(1) Emulsions J to L were reduction sensitized at the preparation of silver halide grains using thiourea dioxide and thiosulfonic acid according to the Example of JP-A-2-191938.

The compounds used for preparing the color photographic material are shown below.

ExC-1
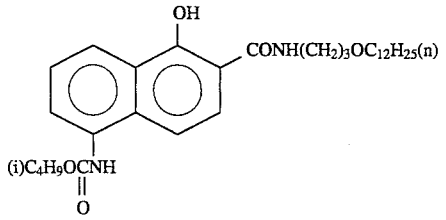
ExC-2
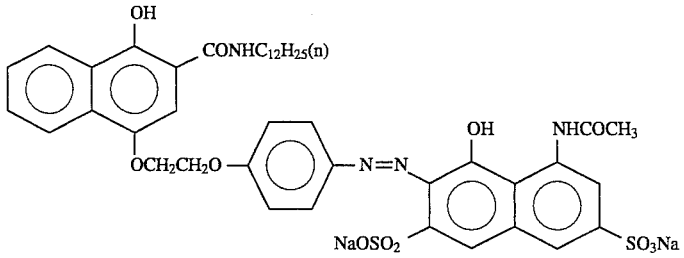
ExC-3
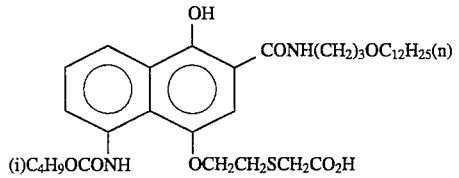
ExC-4
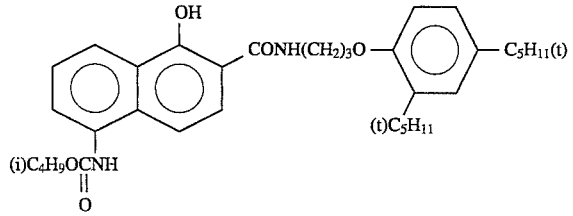
ExC-5
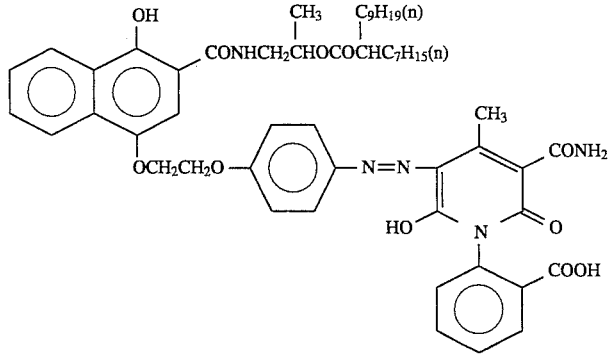
ExC-6
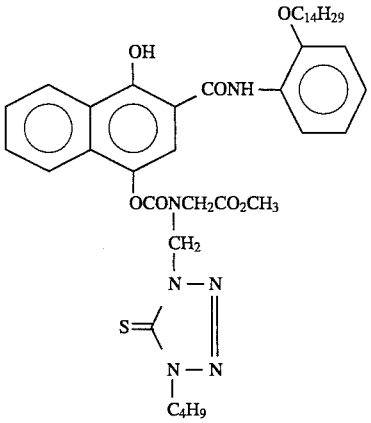
ExC-7
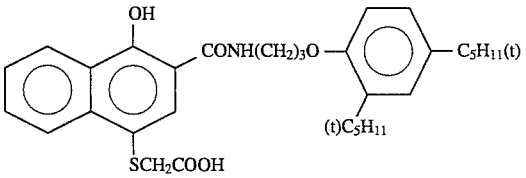

-continued
ExC-8
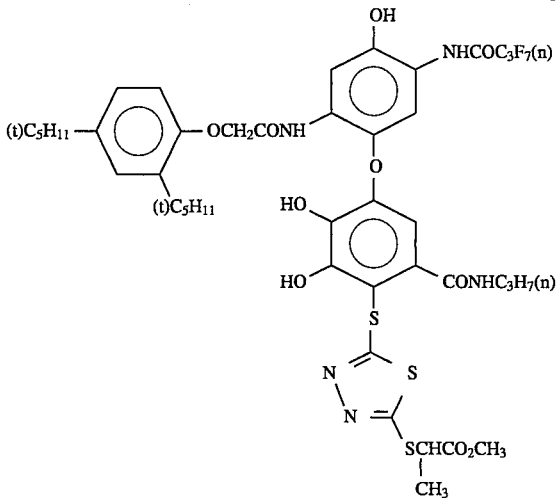
ExM-1
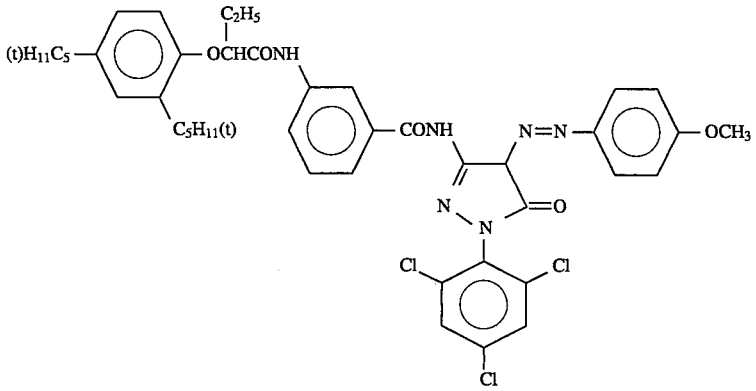
ExM-2
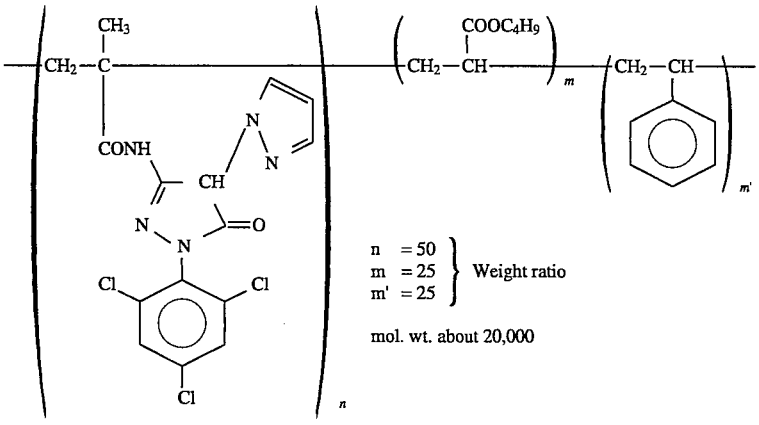
ExM-3
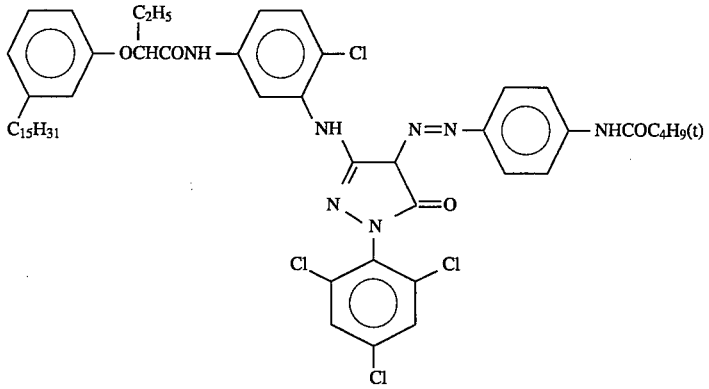

-continued
ExM-4
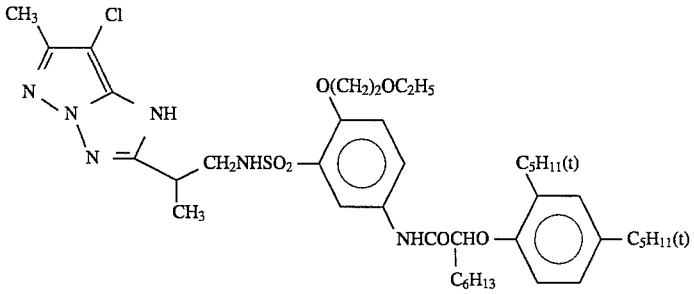
ExM-5
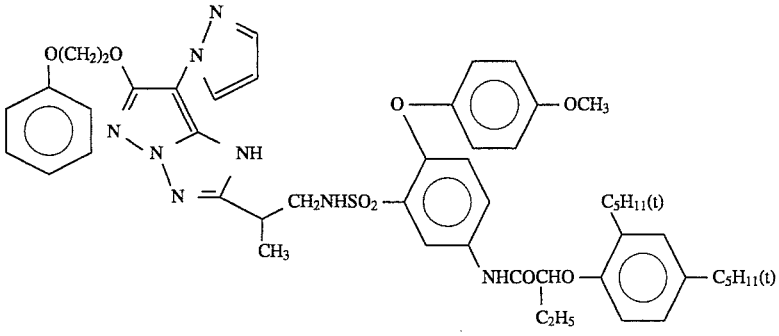
ExY-1
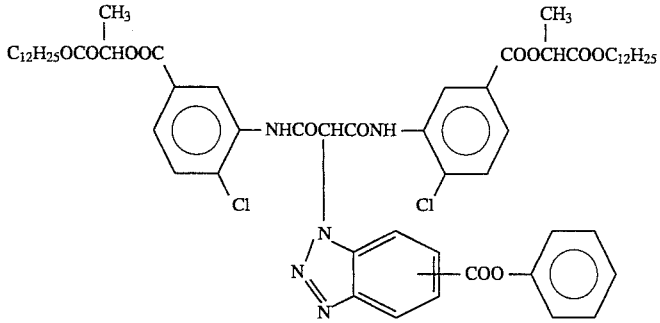
ExY-2
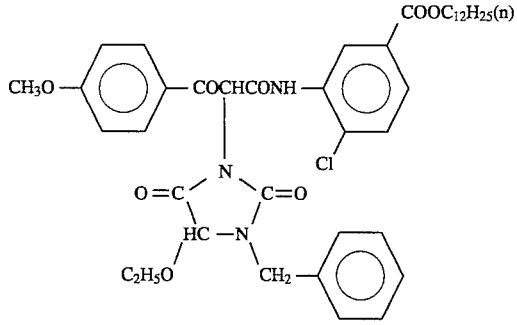
ExY-3
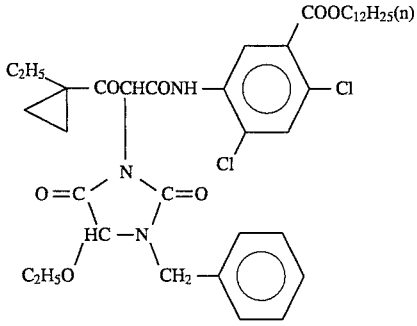
ExY-4
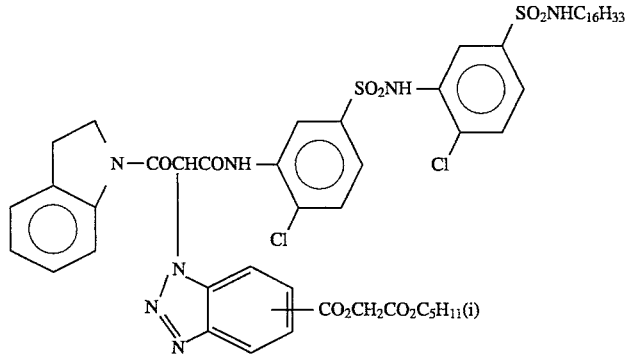

-continued
ExY-5
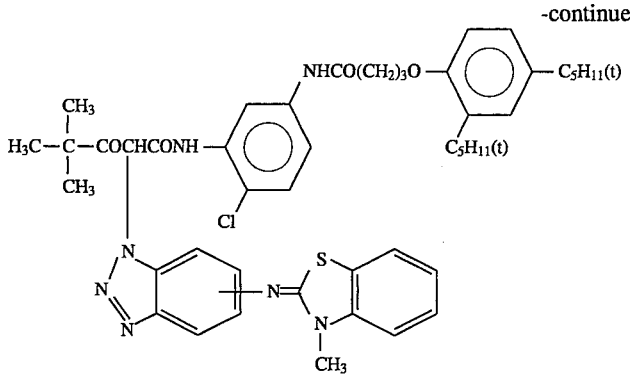
ExF-1
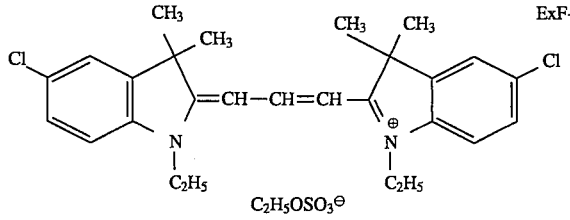
ExF-2
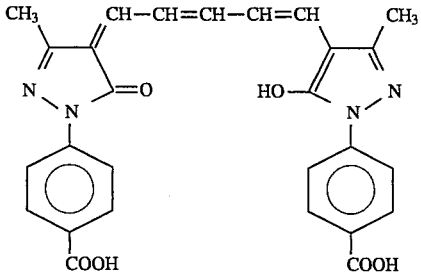
ExF-3
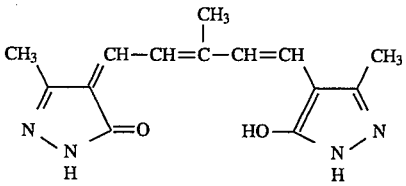
ExF-4
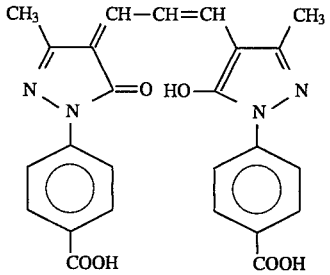
ExF-5
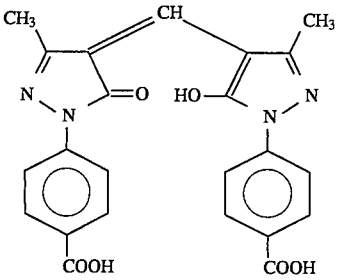
ExF-6
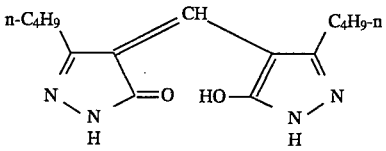
ExF-7
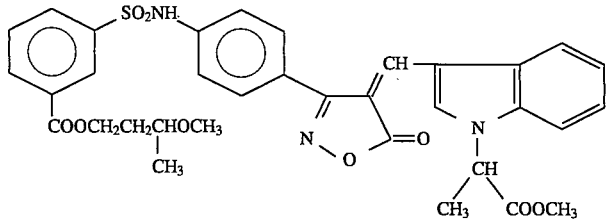
Cpd-1
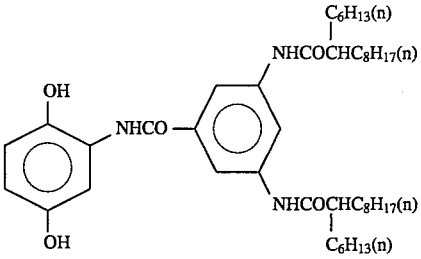
Cpd-2
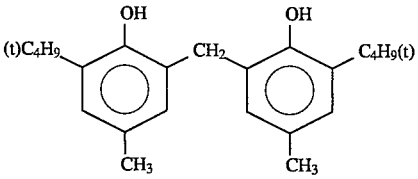

-continued
Cpd-3
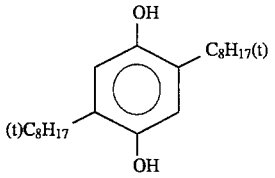
UV-1
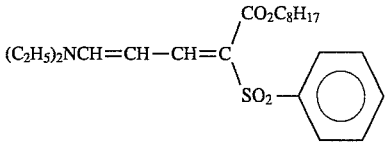
UV-2
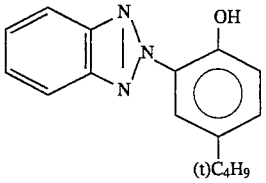
UV-3
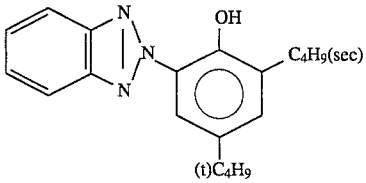
Tricresylphosphate HBS-1
Di-n-butylphthalate HBS-2
HBS-3
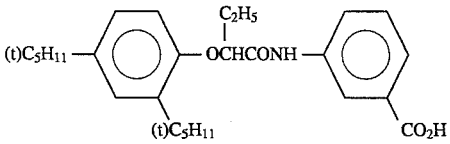
Tri(2-ethylhexyl)phosphate HBS-4
ExS-1
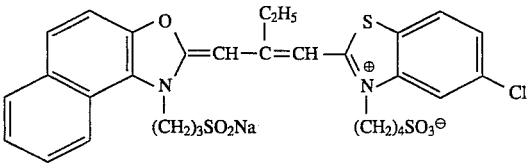
ExS-2
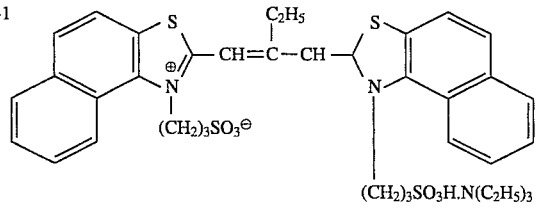
ExS-3
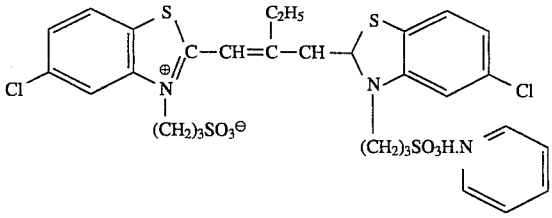
ExS-4
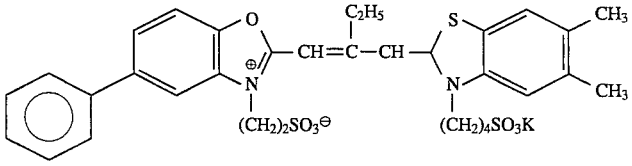
ExS-5
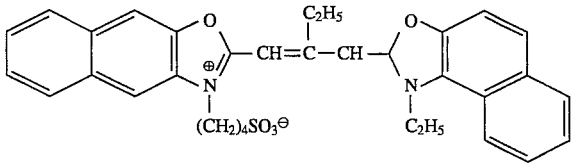
ExS-6
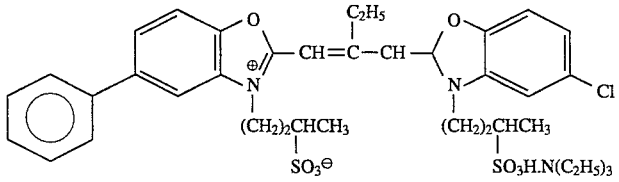

-continued
ExS-7
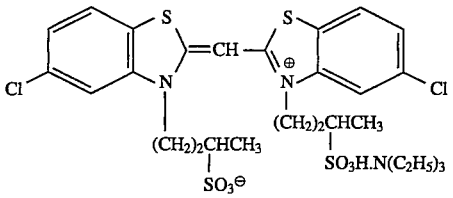
S-1
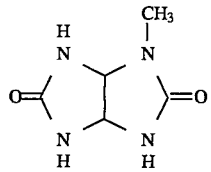
H-1
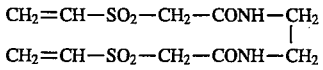
B-1
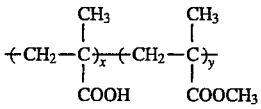
x/y = 10/90 (weight ratio)
B-2
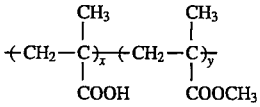
x/y = 40/60 (weight ratio)
B-3
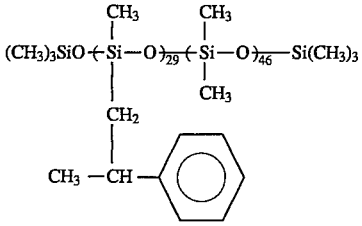
B-4
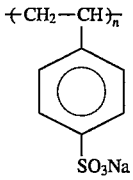
n ≈ 2,000
B-5
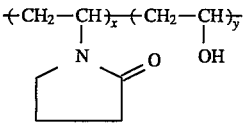
x/y = 70/30 (weight ratio)
B-6
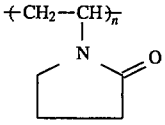
(mol. wt. about 10,000)
W-1
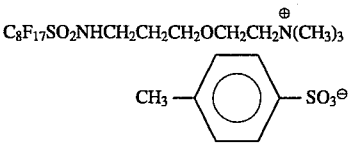
W-2
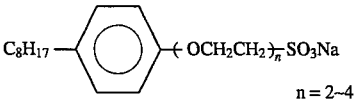
n = 2~4 (mixture)
W-3
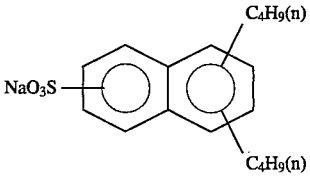
(mixture)
F-1
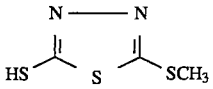
F-2
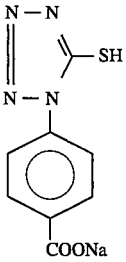
F-3
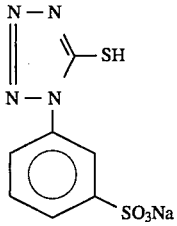
F-4
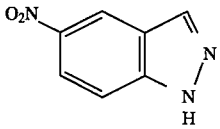
F-5
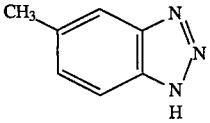
F-6
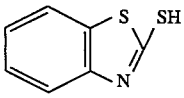

-continued

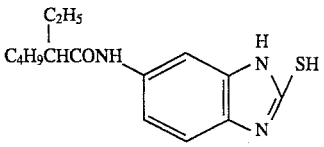

F-7

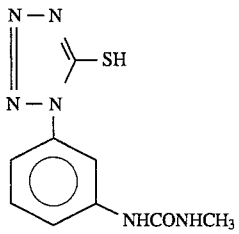

F-8

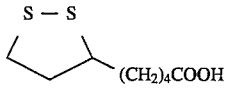

F-9

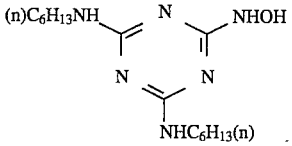

F-10

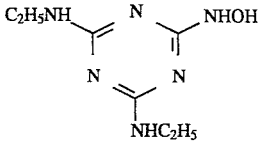

F-11

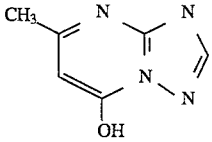

F-12

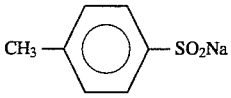

F-13

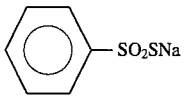

F-14

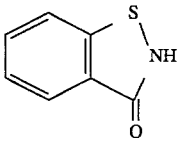

F-15

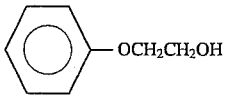

F-16

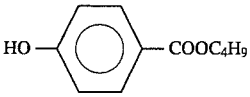

F-17

By following the same procedure as the case of preparing the sample 301 except that the compound of this invention A-1, A-4, A-15, A-17, A-25, A-27, A-29, A-33, A-37, A-40, A-41, A-42, or A-44 was added to Layer 5, Layer 9, Layer 12, and Layer 13 of the sample 301, samples 302 to 314 were prepared.

The addition amount of the compound of this invention was $5.5\times10^{-7}$ mol/mol Ag (Layer 5), $5.5\times10^{-7}$ mol/mol Ag (Layer 9), $2.25\times10^{-7}$ mol/mol Ag (Layer 12), and $2.25\times10^{-7}$ mol/mol Ag (Layer 13).

After storing each sample for 3 days under the condition of 50° C. and 80% in relative humidiy, the sample was subjected to a sensitometric exposure using an optical wedge, and processed by the following processing steps.

Each sample was cut into 35 mm in width, photographed in a camera, and subjected to following processing for 15 days with 1 $m^2$ per day.

In addition, each processing was carried out as follows using an automatic processor FP-560B (manufactured by Fuji Photo Film Co., Ltd.).

The processing steps and the composition of each processing liquid are shown below.

| Step | Processing Time | Processing Temp. | Replenishing Amount* | Tank Volume |
|---|---|---|---|---|
| Color Development | 185 seconds | 38.0° C. | 23 ml | 17 l |

-continued

| Step | Processing Time | Processing Temp. | Replenishing Amount* | Tank Volume |
|---|---|---|---|---|
| Bleach | 50 seconds | 38.0° C. | 5 ml | 5 l |
| Blix | 50 seconds | 38.0° C. | — | 5 l |
| Fix | 50 seconds | 38.0° C. | 16 ml | 5 l |
| Wash with water | 30 seconds | 38.0° C. | 34 ml | 3.5 l |
| Stabilization (1) | 20 seconds | 38.0° C. | — | 3 l |
| Stabilization (2) | 20 seconds | 38.0° C. | 20 ml | 3 l |
| Drying | 90 seconds | 60° C. | | |

*The replening amount was per 35 mm width × 1.1 meters of the sample.

The stabilization was carried out by a countercurrent system of from (2) to (1) and all the overflow liquid from wash water was introduced into the fix bath. The replenishing for the blix bath was carried out as follows. That is, a cut was formed at the upper potion of the bleach tank and the upper portion of the fix tank of the automatic processor such that all the overflow liquid formed with the supply of the replenishers to the bleach tank and the fix tank flowed in the blix bath. In addition, the amount of the developer carried into the bleach step, the amount of the bleach liquid carried into the blix step, the amount of the blix liquid carried into the fix step, and the amount of the fix liquid carried into the wash step were 2.5 ml,. 2.0 ml. 2.0 ml, and 2.0 ml, respectively per 35 mm width×1.1 meters of the sample. The crossover time was 6 seconds in each step and the time was included in the processing time of each of the former step.

Then, the composition of each processing liquid is shown below.

| | Tank liquid | Replenisher |
|---|---|---|
| Color developer | | |
| Diethylenetriaminepentaacetic Acid | 2.0 g | 2.0 g |
| 1-Hydroxyethylidene-1,1-diphosphonic Acid | 2.0 g | 2.0 g |
| Sodium Sulfite | 3.9 g | 5.1 g |
| Poassium Carbonate | 37.5 g | 39.0 g |
| Potassium Bromide | 1.4 g | 0.4 g |
| Potassium Iodide | 1.3 mg | — |
| Hydroxylamine Sulfate | 2.4 g | 3.3 g |
| 2-Methyl-4-[N-ethyl-N-(β-hydroxy-ethyl)amino]aniline Sulfate | 4.5 g | 6.0 g |
| Water to make | 1.0 liter | 1.0 liter |
| pH (adjusted with potassium hydroxide and sulfuric acid) | 10.05 | 10.15 |
| Bleach Liquid | | |
| 1,3-Diaminopropanetetraacetic Acid Ferric Ammonium Monohydrate | 130 g | 195 g |
| Ammonium Bromide | 70 g | 105 g |
| Ammonium Nitrate | 14 g | 21 g |
| Hydroxyacetic Acid | 25 g | 38 g |
| Acetic Acid | 40 g | 60 g |
| Water to make | 1.0 liter | 1.0 liter |
| pH (adjusted with aqueous ammonia) | 4.4 | 4.0 |

Blix Tank Liquid

A mixture of the bleach tank liquid described above and the fix tank liquid shown below at 15/85 by volume ratio.

| Fix Liquid | Tank Liquid | Replenisher |
|---|---|---|
| Ammonium Sulfite | 19 g | 57 g |
| Aqueous Ammonium Thiosulfate Solution (700 g/liter) | 280 ml | 840 ml |
| Imidazole | 15 g | 45 g |
| Ethylenediaminetetraacetic Acid | 15 g | 45 g |
| Water to make | 1.0 liter | 1.0 liter |
| pH (adjusted with aqueous ammonia and acetic acid) | 7.4 | 7.45 |

Wash Water

City water was passed through a mixed bed column filled with a H-type strong acidic cation exchange resin (Amberlite IR-120B) and an OH-type strong basic anion exchange resin (Amberlite IR-400) to reduce the calcium and magnesium ion concentrations below 3 mg/liter and then 20 mg/liter of sodium dichloroisocyanuarate and 150 mg/liter of sodium sulfate were added thereto. The pH of the solution was in the range of from 6.5 to 7.5.

| Stabilization Liquid (Tank Liquid = Replenisher) | |
|---|---|
| Sodium p-toluenesulfinate | 0.03 g |
| Polyoxyethylene-p-monononylphenyl ether (average polyerization degree 10) | 0.2 g |
| Ethylenediaminetetraacetic Acid Disodium Salt | 0.05 g |
| 1,2,4-Triazole | 1.3 g |
| 1,4-Bis(1,2,4-triazol-1-ylmethyl)piperazine | 0.75 g |
| Water to make | 1.0 liter |
| pH | 8.5 |

When on each sample thus processed, the density was measured and the characteristic curve was obtained, it can be seen that in the samples 302 to 314 each added with the compound of this invention, the increase of fog is restrained as compared with the comparative sample 301.

Furthermore, the fog restraining effect was confirmed when the compound of this invention, A-1, A-4, A-15, A-17, A-25, A-27, A-29, A-33, A-37, A-41, A-42, or A-44 to color developer in an amount of $5\times10^{-6}$ mole/liter and the sample 301 exposed was processed using the color developer.

According to the present invention, a silver halide color photographic material, a color developer, and an image-forming process, wherein the formation of fog is prevented without causing the problems of lowering the sensitivity, etc., can be provided.

While the invention has been described in detail and with reference to specific embodiments thereof, it will be apparent to one skilled in the art that various changes and modifications can be made therein without departing from the spirit and scope thereof.

What is claimed is:

1. An image-forming process of a silver halide photographic material having at least one light-sensitive silver halide emulsion layer on a support, which comprises image-wise exposing the photographic material and developing the exposed photographic material using a developer in the presence of a compound represented by formula (I);

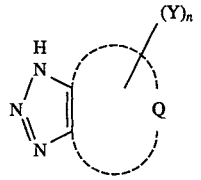

(I)

wherein Q represents a non-metallic atomic group having at least one of a nitrogen atom, an oxygen atom, and a sulfur atom and which is necessary for forming a 5-membered heterocyclic ring together with the two carbon atoms of the 1,2,3-triazole ring; Y represents a substituent; and n represents 0 or an integer of from 1 to 3, when n is 2 or 3, Y's may be the same or different.

2. The image forming process as in claim 1, wherein the substituent represented by Y is selected from the group consisting of a halogen atom, a hydroxy group, a cyano group, a nitro group, —COOM, —$SO_3$M, and —SM (wherein M represents H or an alkali metal atom), an alkyl group, a cycloalkyl group, an alkenyl group, an aryl group, a heterocyclic group, an alkoxy group, a cycloalkyloxy group, an aryloxy group, a heterocyclic ring oxy group, silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl, an aryloxycarbonyl group, a carbamoyl group, an amino group, an anilino group, a heterocyclic ring amino group, a carbonamido group, a ureido group, an imido group, an alkoxycarbonylamino group, an aryloxycarbonylamino group, a sulfonamido group, a sulfamoylamino group, an azo group, an alkylthio group, an arylthio group, a heterocyclic ring thio group, an alkanesulfinyl group, an arenesulfinyl group, an alkane sulfonyl group, an arenesulfonyl group, a sulfamoyl group, and a phosphinoyl group.

3. The image forming process as in claim 2, wherein the substituent represented by Y is further substituted with at least one of substituents selected from the group consisting of a halogen atom, an alkyl group, a cycloalkyl group, an alkenyl group, an aryl group, a heterocyclic group, a acyano group, a nitro group, an alkoxy group, an aryloxy group, a heterocyclic ring oxy group, an acyloxy group, an alkoxycarbonyloxy group, a cycloalkyloxycarbonyl group, an aryloxycarbonyloxy group, an alkylthio group, an arylthio group, a heterocyclic ring thio group, a carbamoyloxy group, a sulfamoyloxy group, an alkanesulfonyloxy group, an arenesulfonyloxy group, an alkoxycarbonyl group, a cycloalkyloxycarbonyl group, an aryloxycarbonyl group, a caramoyl group, an amino group, an anilino group, a heterocyclic ring amino group, a carbonamido group, a ureido group, an imido group, an alkoxycarbonylamino group, an aryloxycarbonylamino group, a sulfonamido group, a sulfamoylamino group, an alkanesulfonyl group, an arenesulfonyl group, a sulfamoyl group, —COOM, —$SO_3M$ and —SM (M represents H or an alkali metal atom), a hydroxy group, an azo group, a sulfinyl group, and a phosphinoyl group.

4. The image forming process as in claim 1, wherein the substituent represented by Y is an alkyl group, an aryl group, an alkoxy group, an aryloxy group, an acyloxy group, an alkylthio group, an arylthio group, a heterocyclic ring thio group, a carbmoyloxy group, a sulfamoyloxy group, an alkanesulfonyloxy group, an arenesulfonyloxy group, an alkoxycarbonyl group, an aryloxycarbonyl group, a carbamoyl group, an amino group, an anilino group, a heterocyclic ring amino group, a carbonamido group, a ureido group, an imido group, an alkoxycarbonyolamino group, an aryloxycarbonylamino group, an alkanesulfonyl group, an arenesulfonyl group, a sulfamoyl group, —COOM, —$SO_3M$, —SM (wherein M represents H or an alkali metal atom), a hydroxy group, or a phosphinoyl group.

5. The image forming process as in claim 1, wherein n is 1, 2 or 3.

6. The image forming process as in claim 1, wherein the compound represented by formula (I) is represented by formula (II) to (XV):

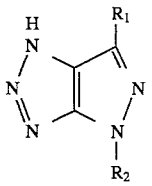

(II)

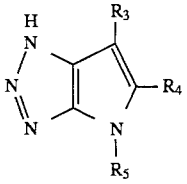

(III)

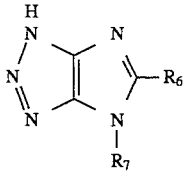

(IV)

-continued

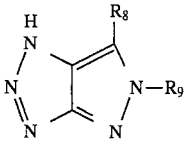

(V)

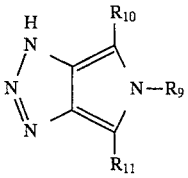

(VI)

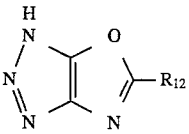

(VII)

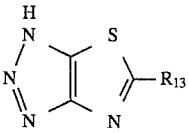

(VIII)

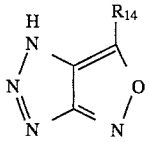

(IX)

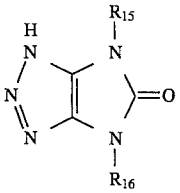

(X)

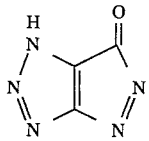

(XI)

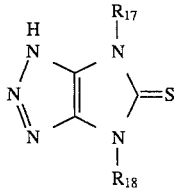

(XII)

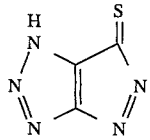

(XIII)

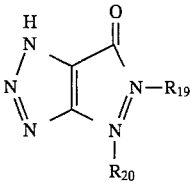

(XIV)

-continued (XV)

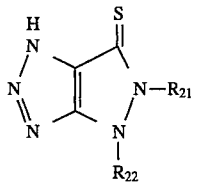

wherein $R_1$ to $R_{22}$ each represents a hydrogen atom or a substituent.

7. The image forming process as in claim 1, wherein the compound is incorporated in the silver halide photographic material.

8. The image forming process as in claim 1, wherein the compound is incorporated in the developer or a pre-bath thereof.

9. A silver halide photographic material having at least one light-sensitive silver halide emulsion layer on a support, wherein the photographic material contains at least one compound represented by formula (I);

(I)

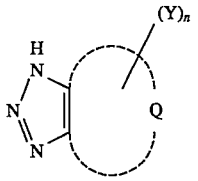

wherein Q represents a non-metallic atomic group having at least one of a nitrogen atom, an oxygen atom, and a sulfur atom and which is necessary for forming a 5-membered heterocyclic ring together with the two carbon atoms of the 1,2,3-triazole ring; Y represents a substituent; and n represents 0 or an integer of from 1 to 3, when n is 2 or 3, Y's may be the same or different.

10. The silver halide photographic material as in claim 9, wherein the compound is contained in an amount of from $10^{-8}$ to $10^{-2}$ mole per mole of silver.

11. The silver halide photographic material as in claim 9, wherein the compound is contained in at least one of the light-sensitive silver halide emulsion layer(s) and a light-insensitive layer(s) provided on the support.

* * * * *